US007556548B2

(12) United States Patent
Konakawa et al.

(10) Patent No.: US 7,556,548 B2
(45) Date of Patent: Jul. 7, 2009

(54) EXHAUST DEVICE FOR OUTBOARD MOTOR

(75) Inventors: Tsugunori Konakawa, Shizuoka (JP); Yoshihiko Atsumi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/829,499

(22) Filed: Jul. 27, 2007

(65) Prior Publication Data

US 2008/0026654 A1 Jan. 31, 2008

(30) Foreign Application Priority Data

Jul. 27, 2006 (JP) ..... 2006-204700

(51) Int. Cl.

| | |
|---|---|
| ***B63H 21/00*** | (2006.01) |
| *B63H 20/00* | (2006.01) |
| *F16C 35/077* | (2006.01) |
| *B63H 21/32* | (2006.01) |
| *F01N 3/04* | (2006.01) |
| *F01N 7/00* | (2006.01) |
| *F01N 3/20* | (2006.01) |
| *F01N 7/12* | (2006.01) |

(52) U.S. Cl. ..... 440/89 R; 440/89 A; 440/89 B; 440/89 C; 440/89 D

(58) Field of Classification Search ..... 440/89 R, 440/89 A, 89 B, 89 C, 89 D
See application file for complete search history.

(56) References Cited

U.S. PATENT DOCUMENTS

| | | | | |
|---|---|---|---|---|
| 3,127,866 A * | 4/1964 | Mohr | ..... | 440/52 |
| 3,431,882 A * | 3/1969 | Irgens | ..... | 440/52 |
| 4,881,370 A * | 11/1989 | Sakurai et al. | ..... | 60/310 |

FOREIGN PATENT DOCUMENTS

| | | |
|---|---|---|
| JP | 2000-265836 A | 9/2000 |
| JP | 2008031898 A * | 2/2008 |

* cited by examiner

*Primary Examiner*—Lars A Olson
*Assistant Examiner*—Daniel V Venne
(74) *Attorney, Agent, or Firm*—Knobbe, Martens, Olson & Bear, LLP

(57) ABSTRACT

An exhaust device for an outboard motor includes an engine having a plurality of cylinders, a first expansion chamber case for collecting exhaust from a first part of the plurality of cylinders and a second expansion chamber case for collecting therein exhaust from a second part of the plurality of cylinders. First and second exhaust passages can extend individually from the first and second expansion chamber cases, respectively, and can communicate with water at the downstream end openings.

8 Claims, 21 Drawing Sheets

EXHAUST DEVICE FOR OUTBOARD MOTOR

PRIORITY INFORMATION

This application is based on and claims priority to Japanese Patent Application No. 2006-204700, filed Jul. 27, 2006, the entire contents of which is hereby expressly incorporated by reference.

BACKGROUND OF THE INVENTIONS

1. Field of the Inventions

The present inventions relate to exhaust devices, for example, exhaust devices that can be used for outboard motors which can reduce or prevent mutual interference of exhaust pulses from a plurality of cylinders of an engine.

2. Description of the Related Art

Japanese Patent Document JP-A-2000-265836 discloses a known exhaust device of a multicylinder engine. In this engine, one set of exhaust passages extending respectively from a plurality of cylinders subjected to odd-numbered ignitions are joined at a point to form a first joined passage and another set of exhaust passages extending respectively from a plurality of cylinders subjected to even-numbered ignitions are joined at another point to form a second joined passage. These joined passages are further joined at another point into single consolidated exhaust passage. The downstream end of the consolidated exhaust passage communicates with the ambient atmosphere. With this structure, exhaust pulses from the cylinders ignited in serial order are prevented from interfering with each other, and thus enhanced performance of the engine is provided.

SUMMARY OF THE INVENTIONS

The engine described in Japanese Patent Document JP-A-2000-265836 is used as a drive source for an outboard motor. It is generally desirable to make the engines of outboard motors as small as possible to reduce the aerodynamic drag created by the outboard motor, as well as for other reasons. To make such engines more compact, the length of the exhaust passages can be shortened. In this case, the cylinders subjected to odd-numbered explosions, which occur prior, and the cylinders subjected to even-numbered explosions, which occur later and subsequently to the former, will be positioned in proximity to each other because of the length of the shortened exhaust passages described above.

As a result, exhausts from the cylinders subjected to later explosions tend to interfere with exhausts from the cylinders subjected to prior explosions. Thus, in the exhaust passages extending from the cylinders subjected to earlier explosions, desired exhaust pulses having a sufficiently high negative pressure may not be obtained.

When the negative pressure of exhaust pulses is not sufficiently high as described above, the exhaust is not released properly from the cylinders. This causes a knocking due to the burnt gas left in the cylinders, a misfiring, increased pumping losses, and decreased volumetric efficiency due to an improper intake of fresh air. As a result, engine output, fuel economy and exhaust efficiency may decrease.

Thus, in accordance with an embodiment, an exhaust device for an outboard motor can comprise an engine having a plurality of cylinders. A first expansion chamber case can be configured to collect therein exhaust from a first part of the plurality of cylinders. A second expansion chamber case can be configured to collect therein exhaust from a second part of the plurality of cylinders. First and second exhaust passages can extend individually from the first and second expansion chamber cases, respectively, each of the first and second exhaust passages can have a downstream end opening communicating with water.

In accordance with another embodiment, an outboard motor can comprise an engine having a plurality of cylinders. A case can include a lower portion configured to be submerged in water during operation of the outboard motor. A first expansion chamber case can be configured to collect therein exhaust from a first group of the plurality of cylinders. A second expansion chamber case can be configured to collect therein exhaust from a second group of the plurality of cylinders. First and second exhaust passages can extend individually from the first and second expansion chamber cases, respectively, each of the first and second exhaust passages having separate downstream end openings disposed on the lower portion.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENTS

Figure 1:
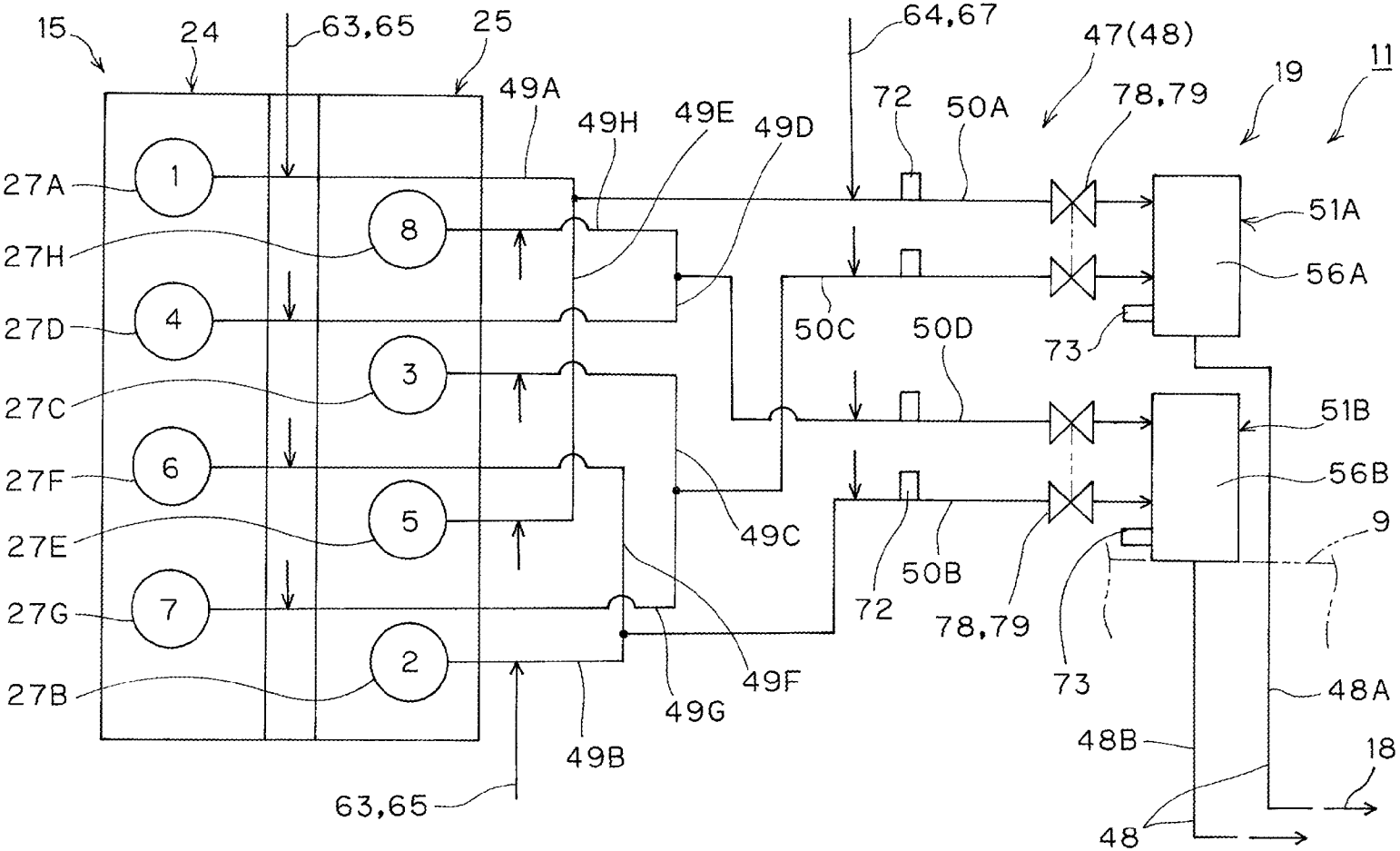
FIG. 1 is a schematic diagram generally illustrating an engine in accordance with an embodiment.

Improved exhaust systems for an engine 11 (FIG. 1) are disclosed herein. Although the present exhaust systems are illustrated and described in the context of an outboard motor, certain aspects of the present inventions can be used with engines of other types of vehicles, as well as with other types of prime movers.

In some embodiments, an exhaust device for an outboard motor is configured to reduce or prevent mutual interference of exhausts from a plurality of cylinders of an engine of the outboard motor, thereby providing enhanced performance of the engine more reliably.

For example, in some embodiments, an exhaust device for an outboard motor can include an engine having a plurality of cylinders. A first expansion chamber case can be configured to collect therein exhaust from a first part of the plurality of cylinders. A second expansion chamber case can also be configured to collect therein exhaust from a second part of the plurality of cylinders. First and second exhaust passages can extend individually from the first and second expansion chamber cases, respectively, and communicate with water at the downstream end openings.

Referring to FIGS. 1 to 4, a small watercraft 1 (FIG. 2) can be designed to float on the surface of water 2 such as the sea. The arrow Fr indicates the forward direction in which the watercraft 1 is driven. The term "left and right" used herein refers to the width direction of the watercraft 1 with respect to the above forward direction.

The watercraft 1 can include a hull 3 designed to float on the surface of the water 2, and an outboard motor 4 supported at the stern of the hull 3. The outboard motor 4 can include an outboard motor body 5 for producing propulsive force to selectively drive the hull 3 forward or rearward, and a bracket 6 for supporting the outboard motor body 5 on the hull 3.

The outboard motor body 5 can include a case 9, a propeller 10, an engine 11, a power transmission apparatus 12 and a cowling 13. The case 9 can extend generally vertically, and can be supported on the hull 3 by the bracket 6.

A lower portion of the case 9 can be designed to be submerged in the water 2. The propeller 10 is supported at the lower end of the case 9. The engine 11 is supported at the upper end of the case 9. The power transmission apparatus 12 is enclosed in the case 9, and operatively connects the propeller 10 to the engine 11. The cowling 13 selectively covers and uncovers the engine 11 on the outside thereof It should be noted that the "surface 2*a* of the water 2" described above is the water level during the watercraft 1 being driven forward, and can fluctuate vertically to some degree.

The power transmission apparatus 12 can include a gear switching device 14 for changing the driving state of the propeller 10 between a forward drive mode, a reverse drive mode and a neutral mode, through a user's manual operation. The operation of the switching device 14 allows the hull 3 to be selectively driven either forward or rearward, or to be allowed to drift, during operation of the engine 11.

Referring to FIGS. 1 to 8, the engine 11 is a four-stroke V-type engine having a plurality of (eight) cylinders, and is used as a drive source for the outboard motor 4. However, this is merely one type of engine that can be used. Those skilled in the art readily appreciate that the present exhaust systems and exhaust components can be used with any of a variety of engines having other numbers of cylinders, and/or other cylinder arrangements, and/or operating on other principles of operation (diesel, 2-stroke, rotary, etc.).

The engine 11 includes an engine body 15, an intake device 17 and an exhaust device 19. The engine body 15 is supported on the top of the case 9. The intake device 17 supplies a mixture of ambient air 16 and fuel to the engine body 15. The exhaust device 19 discharges burnt gas resulting from combustion of the mixture in the engine body 15 to the outside of the engine 11 as exhaust 18. The case 9 has an oil tank 20 having stored therein lubricant for lubricating various parts of the engine body 15.

The engine 11 can include an engine body 15, an intake device 17 and an exhaust device 19. The crankcase 23 can be supported on the top of the case 9, and can support a crankshaft 22 for rotation about a vertical axis 21.

Figure 7:
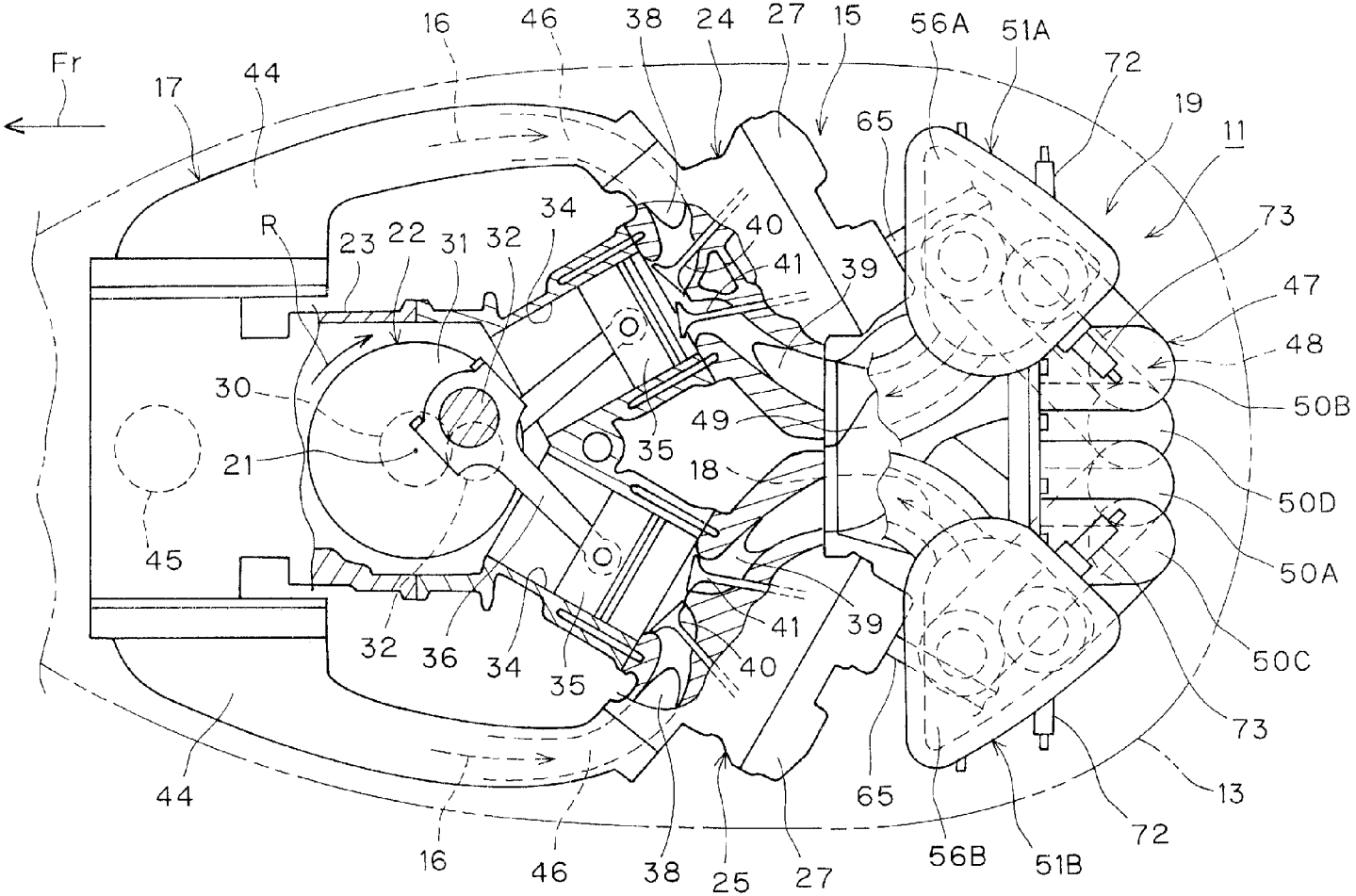
FIG. 7 is a partial bottom plan and schematic cross-sectional view of the engine.

The left and right banks 24 and 25 project horizontally to the outside, or rearward and toward the sides, from the crankcase 23 in a V-configuration as viewed in the bottom view of the engine 11 (FIG. 7). The angle made by the banks 24, 25, specifically by first to eighth cylinders 27A to 27H, is approximately 60°. The first to eighth cylinders 27A to 27H are ignited sequentially in that order.

For example, one (left) bank 24 of the banks 24, 25 can be formed by the first, fourth, sixth and seventh cylinders 27A, 27D, 27F and 27G. The cylinders 27A, 27D, 27F, 27G can be arranged in the downward direction in that order.

The other (right) bank 25 can be formed by the eighth, third, fifth and second cylinders 27H, 27C, 27E and 27B. The cylinders 27H, 27C, 27E, 27B can be arranged in the downward direction in that order. The first to eighth cylinders 27A to 27H can be arranged in the downward direction in order of the first cylinder 27A, the eighth cylinder 27H, the fourth cylinder 27D, the third cylinder 27C, the sixth cylinder 27F, the fifth cylinder 27E, the seventh cylinder 27G and the second cylinder 27B.

With reference to FIG. 7, the crankshaft 22 can include a crank main shaft 30, crank arms 31 and crankpins 32. The crank main shaft 30 can be positioned about the axis 21, and can have journals supported by the crankcase 23.

The crank arms 31 can project from the crank main shaft 30. The crankpins 32 can be supported by the respective crank arms 31, and associated respectively with the first to eighth cylinders 27A to 27H. The angle made by the banks 24, 25 can be approximately 60° as described above. The eight crankpins 32 associated with the first to eighth cylinders 27A to 27H can be arranged in the following manner, as viewed in the bottom view of the engine 11 (FIG. 7).

For example, the crankpins 32 associated with the first, eighth, fourth, third, seventh, second, sixth and fifth cylinders can be arranged in that order in the counterclockwise direction of the crankshaft 22. The angle made by the crankpins 32 associated with each pair of the first and eighth cylinders, the fourth and third cylinders, the seventh and second cylinders, and the sixth and fifth cylinders can be 30°. The angle made by the crankpins 32 associated with each pair of the eighth and fourth cylinders, the third and seventh cylinders, the second and sixth cylinders, and the fifth and first cylinders can be 60°. That is, the crankshaft 22 can be of similar type to that of so-called cross plane/double plane/dual plane crank type of a V-type, multicylinder engine having a bank angle of 90°.

Each of first to eighth cylinders 27A to 27H can include a piston 35 and a connecting rod 36. The piston 35 can be fitted in a cylinder bore 34 of each cylinder in a manner sliding axially therealong. The connecting rod 36 can operatively connect the piston 35 and the crankpin 32 of the crankshaft 22.

Each cylinder 27 can have intake and exhaust ports 38 and 39 for communicating the inside and the outside of the cylinder bore 34. Intake and exhaust valves 40 and 41 can be provided for selectively opening and closing the intake and exhaust ports 38 and 39, respectively. The intake and exhaust valves 40 and 41 can be selectively opened and closed in response to a certain crank angle (θ) by a valve device (not shown) operatively connected to the crankshaft 22. However, other types of valve devices or drives can also be used, including variable valve timing systems.

The intake device 17 can include intake pipes 44 extending from the respective cylinders 27, and throttle valves 45 can be attached to the extended ends of the intake pipes 44. However, other types of systems can be used with more or fewer throttle valves, including systems with no throttle valve at all. Such a system can use variable valve timing to meter induction air into the engine 11.

Each intake pipe 44 can have an intake passage 46 defined therein which communicates the ambient atmosphere to the intake port 38 through the throttle valve 45. The throttle valve 45 is configured to adjust the opening of the intake passage 46 at the extended end of the intake pipe 44, and thus "meter" an amount of air flowing therethrough.

Referring to FIGS. 1 to 8, the exhaust device 19 can include an exhaust manifold 47 extending from the cylinders 27. The exhaust manifold 47 can have an exhaust passage 48 defined therein which communicates the exhaust ports 39 to the ambient atmosphere.

The exhaust manifold 47 can also include first to eighth upstream exhaust pipes 49A to 49H, first to fourth midway exhaust pipes 50A to 50D and a downstream exhaust pipe 51. The first to eighth upstream exhaust pipes 49A to 49H can extend individually from the first to eighth cylinders 27A to 27H, respectively.

The first to fourth midway exhaust pipes 50A to 50D can extend respectively from a joined portion of the extended ends of the first and fifth upstream exhaust pipes 49A and 49E, a joined portion of the extended ends of the second and sixth upstream exhaust pipes 49B and 49F, a joined portion of the extended ends of the third and seventh upstream exhaust pipes 49C and 49G, and a joined portion of the extended ends of the fourth and eighth upstream exhaust pipes 49D and 49H.

The exhaust manifold 47 can further include first and second downstream exhaust pipes 51A and 51B. The first and second downstream exhaust pipes 51A and 51B can extend respectively from a joined portion of the extended ends of the first and third midway exhaust pipes 50A and 50C and a joined portion of the extended ends of the second and fourth midway exhaust pipes 50B and 50D, and can connect the respective joined portions to the ambient atmosphere. It should be noted that "to the ambient atmosphere" described above refers to both directly to the ambient atmospheric air and indirectly to the ambient atmosphere through the water 2.

Each pair of the first and fifth upstream exhaust pipes 49A and 49E, the second and sixth upstream exhaust pipes 49B and 49F, the third and seventh upstream exhaust pipes 49C and 49G, and the fourth and eighth upstream exhaust pipes 49D and 49H have approximately the same equivalent length. Of the first to fourth midway exhaust pipes 50A to 50D, the first and fourth midway exhaust pipes 50A and 50D have approximately the same equivalent length. The second and third midway exhaust pipes 50B and 50C have approximately the same equivalent length. The first and fourth midway exhaust pipes 50A and 50D and the second and third midway exhaust pipes 50B and 50C, however, can have a different equivalent length.

Each exhaust port 39 and valve 41 combination can be configured to function as a de Laval nozzle. For example, the exhaust port 39 can have an increasing cross sectional area as it extends to the downstream direction. As a result, during the start of the valve opening motion of the exhaust valve 41, exhaust 18 flowing from the cylinder bore 34 to the exhaust port 39, can be accelerated to Mach 1 by the constriction created between the valve 41 and its seat, then further accelerated beyond Mach 1 by the diverging shape of the port 39 to thereby cause a shock wave.

The exhaust passage 48 of each upstream exhaust pipe 49 can include a diffuser structure. For example, the exhaust passage 48 can have an increasing cross sectional area as it extends toward the downstream side. The length of the upstream exhaust pipe 49 and the midway exhaust pipe 50 can be set to be sufficiently long such that the distance from the end face of the exhaust valve 41 on the cylinder bore 34 side to the downstream end of the midway exhaust pipe 50 can be about 300 mm or larger. However, other configurations and sizes can also be used.

For example, the upstream exhaust pipe 49 can have a diffuser structure, and in addition, the upstream exhaust pipe 49 and the midway exhaust pipe 50 can be relatively long. As a result, the shock wave generated in the exhaust port 39, and a portion passed over the exhaust port 39 can form a dilatational wave more efficiently. That is, the negative pressure of exhaust pulses in the exhaust port 39, the upstream exhaust pipe 49 and the midway exhaust pipe 50 can be increased.

The downstream exhaust pipes 51A, 51B can have first and second expansion chamber cases 56A and 56B, respectively, forming the upstream sides thereof and connected to the downstream ends of the midway exhaust pipes 50. The first and second expansion chamber cases 56A and 56B can serve as surge tanks.

The downstream sides of the downstream exhaust pipes 51A, 51B can be formed by the above case 9. For example, the case 9 can include a pair of left and right first and second exhaust passages 48A and 48B for communicating the exhaust passages 48 in the first and second expansion chamber cases 56A and 56B individually to the water 2. The first and second exhaust passages 48A and 48B form the downstream side of the exhaust passage 48 of the exhaust manifold 47.

The downstream ends of the first and second exhaust passages 48A and 48B in the case 9 can be each bifurcated into two passages. Of the bifurcated passages of the first and second exhaust passages 48A and 48B, the (lower) bifurcated passages can have downstream end openings 48*a* and 48*b* communicating with the water 2 in a central area of rotation of the propeller 10. The other (upper) bifurcated passages can have downstream end openings 48*c*, 48*d* formed in a longitudinal (vertical) midway part of the case 9 below the surface 2*a* of the water 2, above the central area of the propeller 10 and communicating with the water 2. The downstream end openings 48*a* to 48*d* can be open rearward in the rear end face of the case 9.

Figure 2:
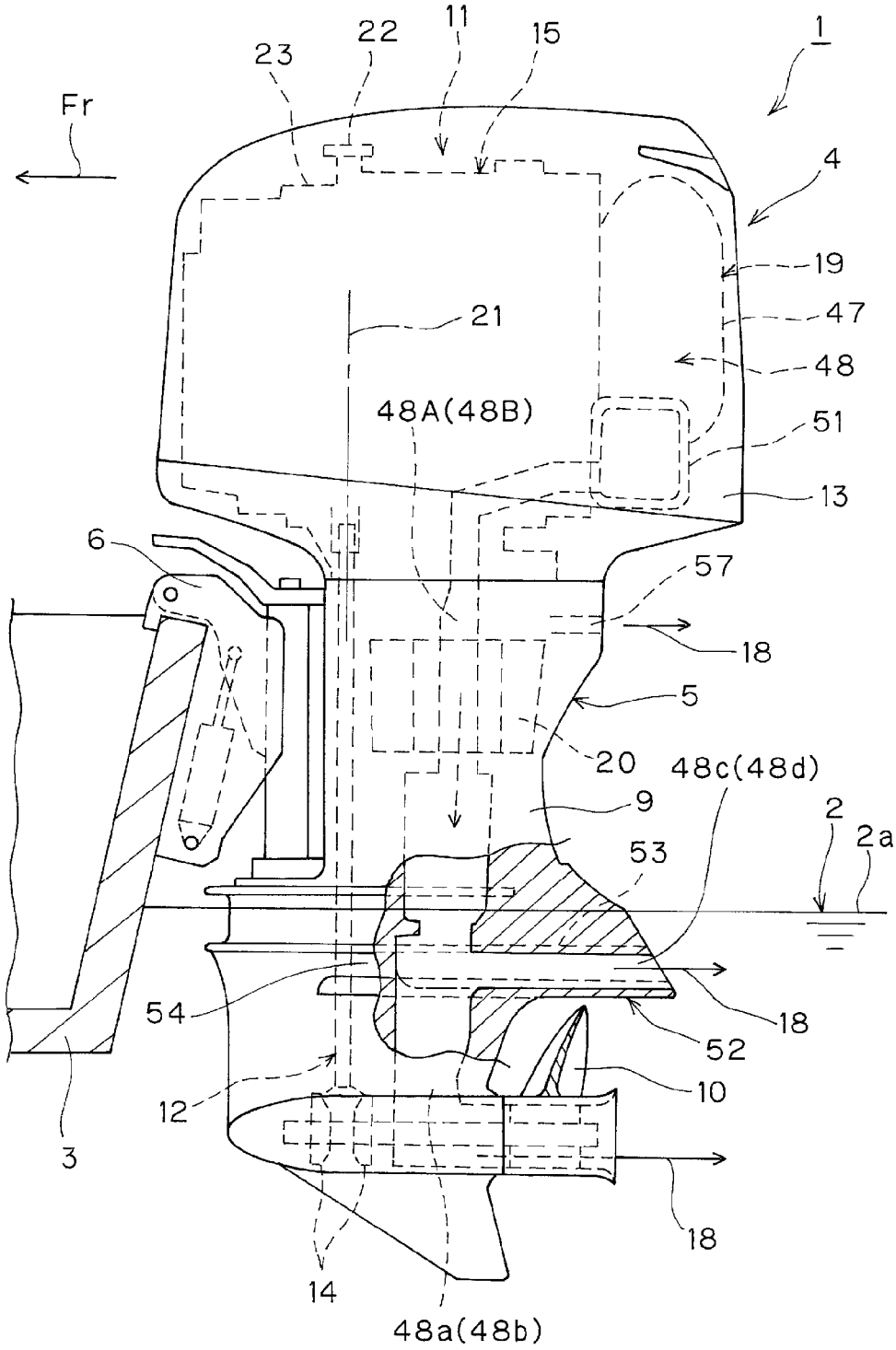
FIG. 2 is a schematic side view of a rear part of a watercraft including an outboard motor which, in turn, can include the engine of FIG. 1.
Figure 3:
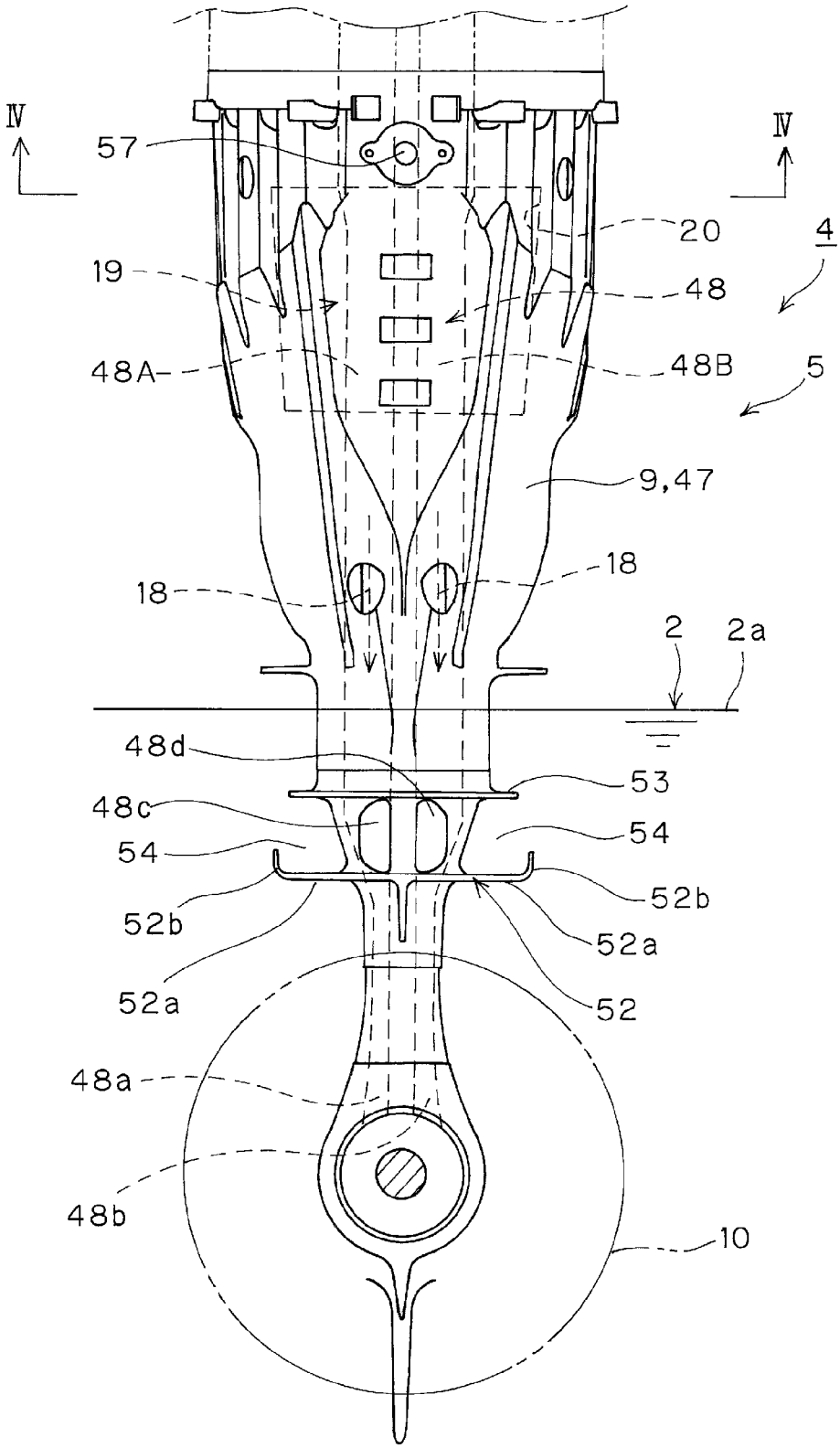
FIG. 3 is a partial rear elevational view of a lower portion of the outboard motor.

With continued reference to FIGS. 2 and 3, a partition 52 can be provided for separating the upper downstream end openings 48*c*, 48*d*, from the lower downstream end openings 48*a* and 48*b* and the propeller 10. In some embodiments, the partition 52 can extend in the longitudinal (forward and backward) direction of the hull 3.

The partition 52 can also be formed together with left and right outer surfaces of the case 9 and can be supported by the case 9. The partition 52 can have the shape of a strip extending longer in the longitudinal direction of the hull 3.

The partition 52 can also include a pair of left and right partition plates 52*a* and a pair of left and right lugs 52*b*. The left and right partition plates 52*a* can project generally horizontally toward the lateral outside directions respectively from the left and right outer surfaces of the case 9 to be integral therewith. The left and right lugs 52*b* can project upwardly from the respective laterally outwardly projected ends of the partition plates 52*a* to be integral therewith.

A water guide 53 can be provided for guiding the water 2 in the rearward direction in cooperation with the partition 52, when the watercraft 1 is driven forwardly. The water guide 53 can be positioned below the surface 2*a* of the water 2 and above and in proximity to the upper downstream end openings 48*c*, 48*d* of the first and second exhaust passages 48A and 48B.

With continued reference to FIGS. 2 and 3, the water guide 53 can face toward the partition 52 in a vertical direction. The water guide 53 can extend generally parallel to the partition 52, and can be formed together with the left and right outer surfaces of the case 9 to be supported by the case 9. A pair of left and right water passages 54 can be defined between the partition 52 and the water guide 53 to extend generally straight in the longitudinal direction of the hull 3.

As seen axially along the downstream ends of the midway exhaust pipes 50 (FIG. 7), in the vicinity of the downstream ends of the midway exhaust pipes 50, the expansion chamber case 56 has a cross sectional area twice as large as or larger than twice the total cross sectional area of the downstream ends of the midway exhaust pipes 50. This provides effective damping on vibration caused by the pressure of the pulses of exhaust 18 flowing from the midway exhaust pipes 50 into the expansion chamber case 56, so that mutual interference of the exhausts 18 can be reduced and/or prevented.

Figure 6:
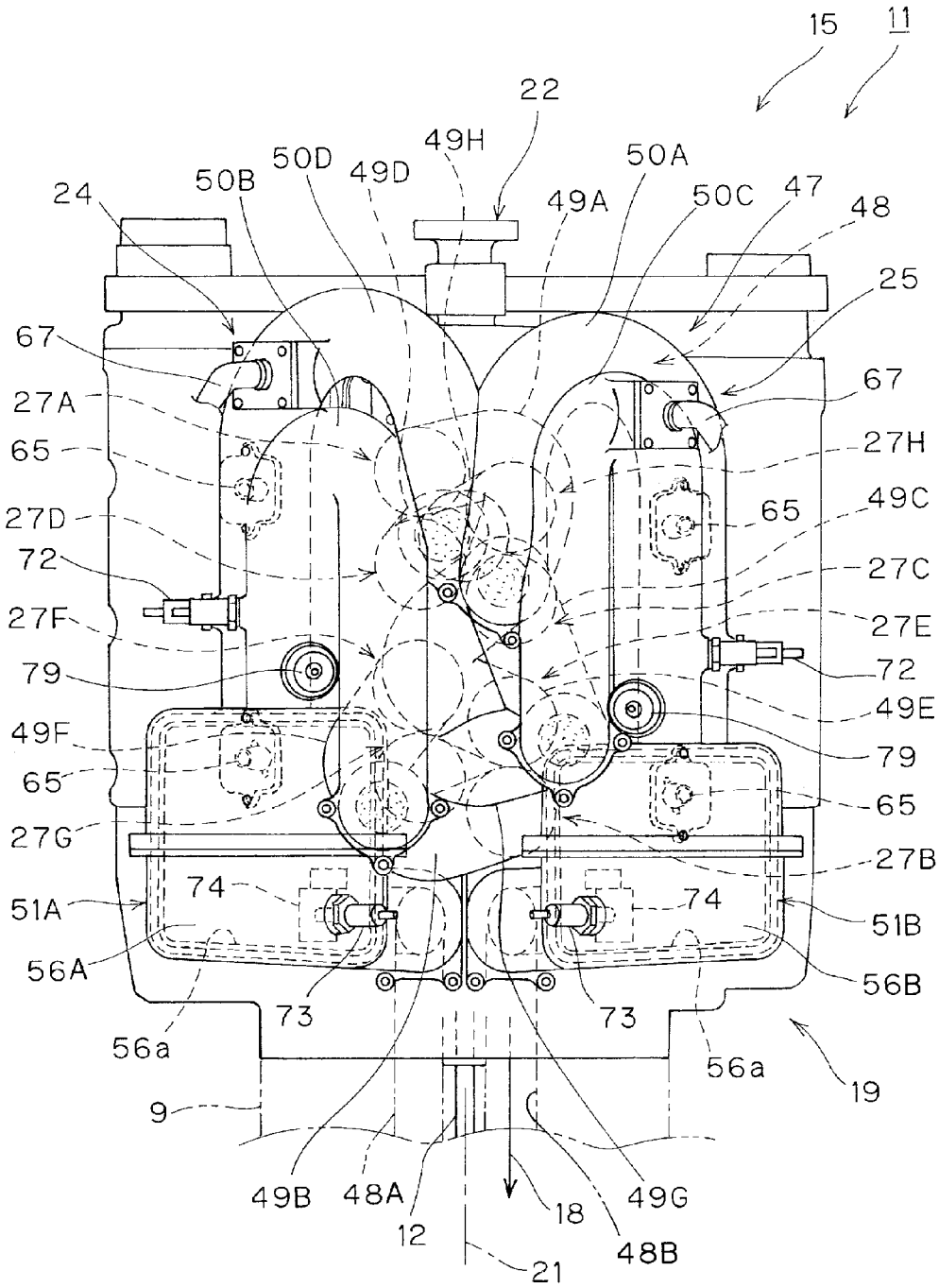
FIG. 6 is a rear elevational view of the engine with certain components of the exhaust system shown in phantom line.

With reference to FIG. 6, the inner bottom 56*a* of the expansion chamber case 56 can be inclined downwardly toward the upstream end of the exhaust passage 48 formed in the case 9. As a result, the water 2 that may collect in a bottom part in the expansion chamber case 56 will flow through the exhaust passage 48 in the case 9 to be drained.

An idling exhaust passage 57 can be formed in the case 9 (FIGS. 2 and 3) for communicating longitudinal midway parts of the exhaust passage 48 in the downstream exhaust pipes 51 and the midway exhaust pipes 50 to the ambient atmosphere above the surface of the water 2.

The upstream exhaust pipes 49, the midway exhaust pipes 50 and the expansion chamber cases 56 of the downstream exhaust pipes 51 of the exhaust manifold 47, and the case 9 can have individual water jackets 58. Cooling water can be pumped through the water jackets 58. As such, the water jackets 58 can prevent the temperature of the exhaust manifold 47 from increasing due to the exhaust 18.

Figure 8:
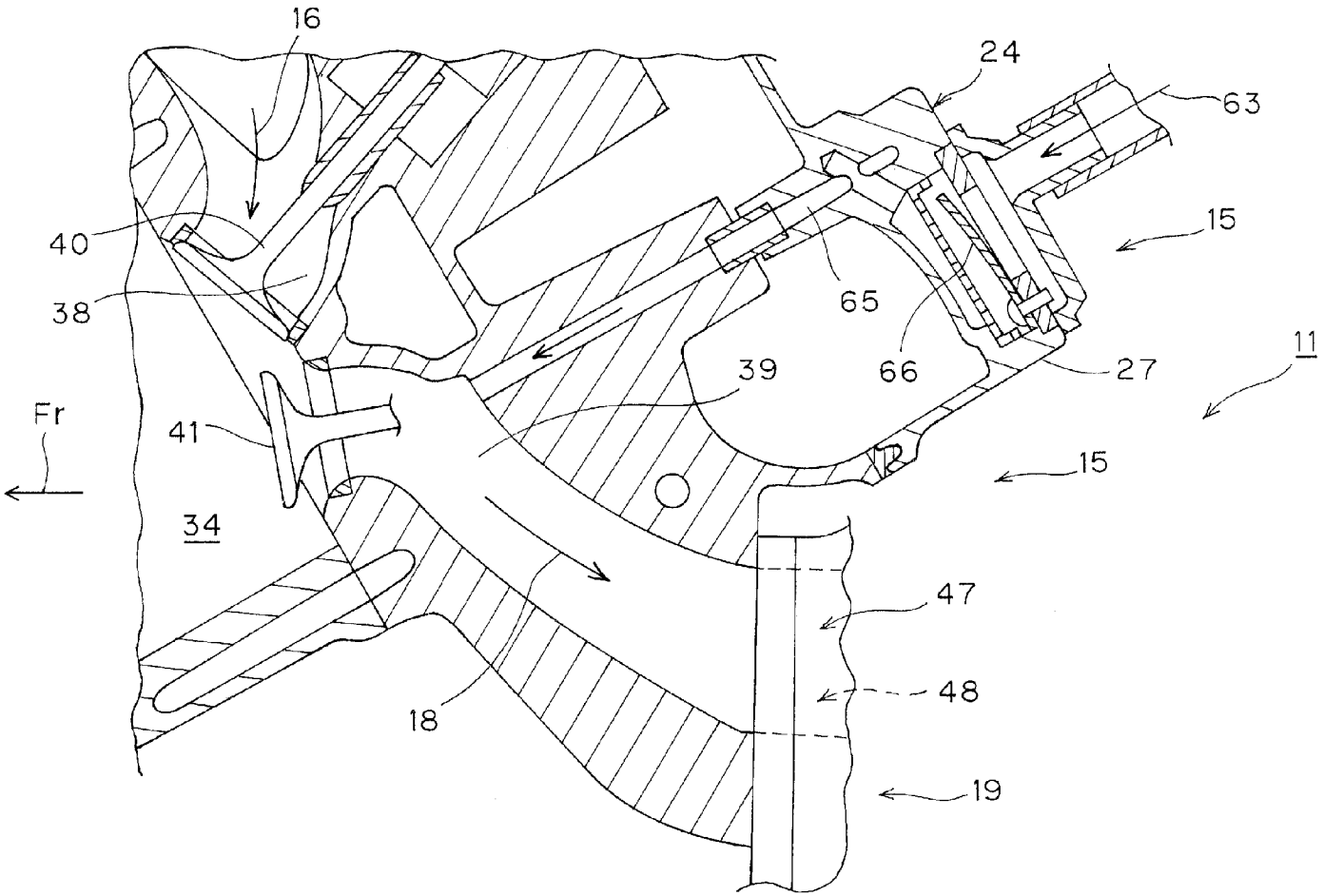
FIG. 8 is an enlarged detailed cross-sectional view of an exhaust port of the engine.
Figure 9:
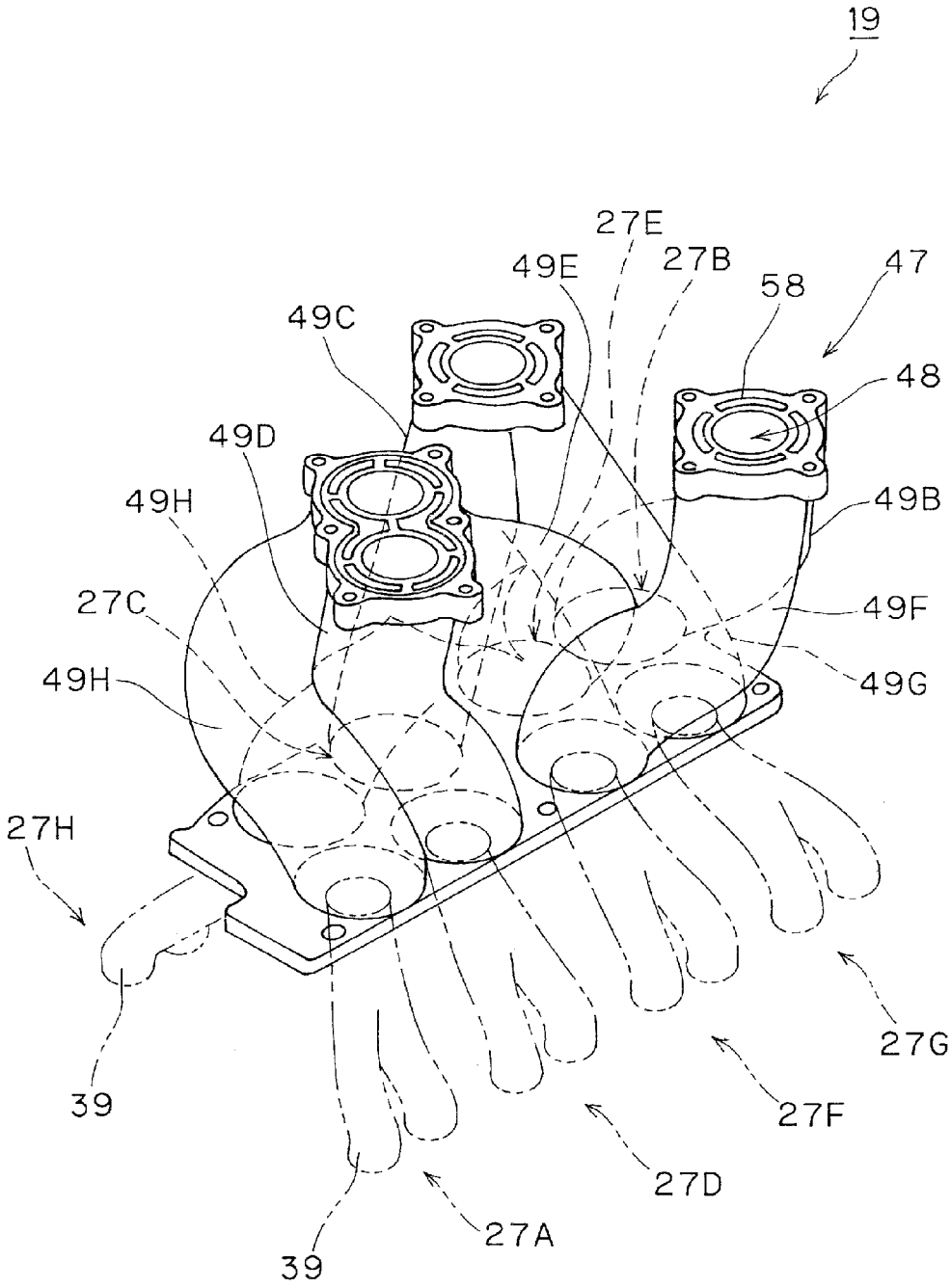
FIG. 9 is a perspective view of a portion of an exhaust device.
Figure 10:
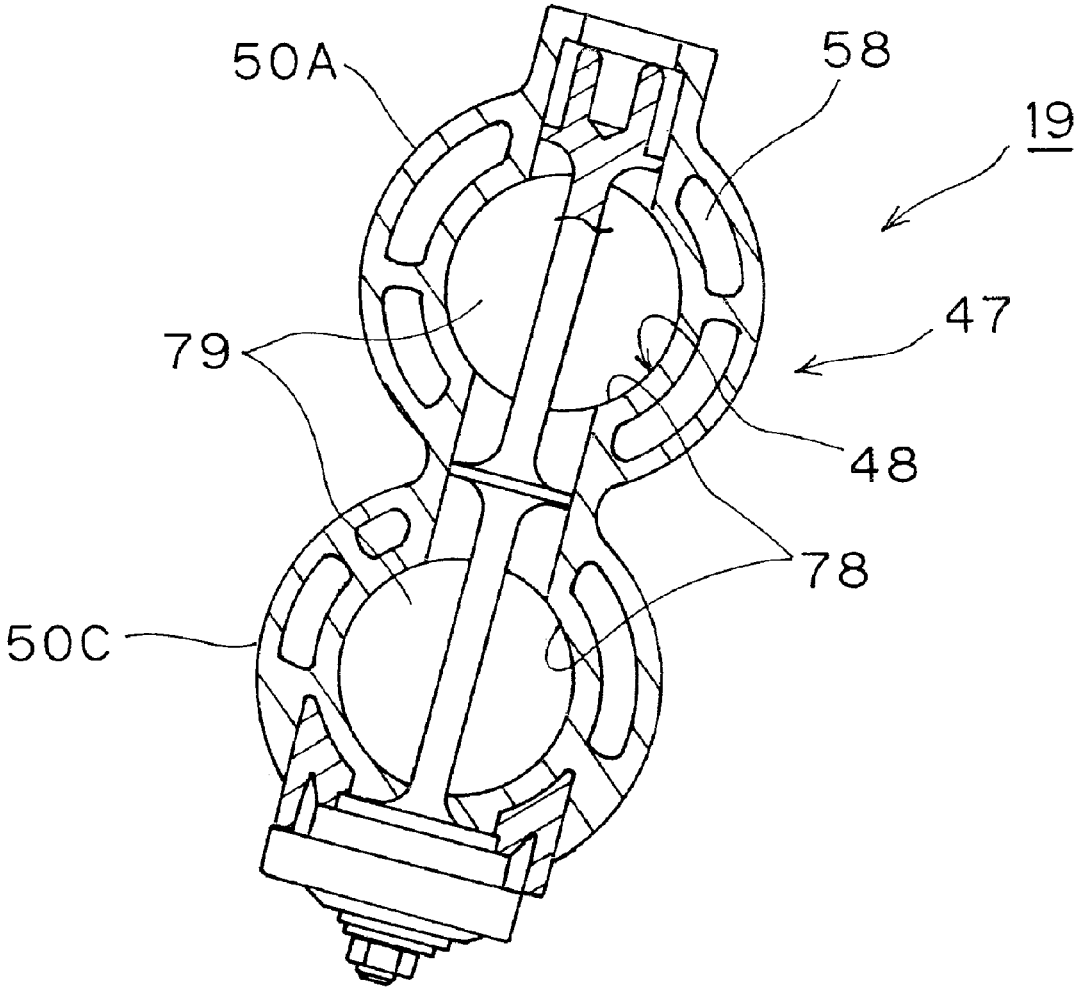
FIG. 10 is a plan and cross-sectional view of regulating parts and regulating valves that can be used with the exhaust device.

Referring to FIGS. 1 and 8, each cylinder 27 can be provided with a first air passage 65 and a reed valve 66 so that first secondary air 63 can be supplied to the upstream side of the exhaust port 39. Referring to FIGS. 1 and 6, second air passages 67 and reed valves can be provided so that second secondary air 64 can be supplied to the exhaust passage 48 in the midway exhaust pipes 50.

First $O_2$ sensors 72 and second $O_2$ sensors 73 can be provided. The first $O_2$ sensor 72 can be disposed downstream of the first and second secondary airs 63, 64, and can be configured to detect the components (concentration of oxygen) of the exhaust 18 flowing through the midway exhaust pipe 50. The second $O_2$ sensor 73 can be also disposed downstream of the first and second secondary airs 63, 64, and can be configured to detect the components of the exhaust 18 flowing through the downstream end of the expansion chamber case 56.

A cover 74 can be provided for covering the second $O_2$ sensor 73 from above. As a result, water droplets can be prevented from falling onto the $O_2$ sensor 73. Accordingly, the $O_2$ sensor can be prevented from being damaged due to water droplets.

Based on the detection signals from the $O_2$ sensors 72, 73, the opening of the intake passage 46 adjusted by the throttle valve 45, the fuel supply amount, and the supply amount of secondary airs 63, 64 can be controlled automatically. Due to such control, enhanced purification of the exhaust 18 can be provided.

When the engine 11 is driven, the crankshaft 22 makes rotation (R), and the first to eighth cylinders 27A to 27H can be ignited sequentially in that order. The ignitions can be performed at predetermined intervals of crank angle (θ), preferably at a 90°. It is understood, however, that the ignitions may not be performed at predetermined intervals but a plurality of (two) cylinders may be ignited almost simultaneously.

Exhaust flows 18 are discharged sequentially from the cylinders 27 through the exhaust manifold 47 in the same order as the cylinders 27 are ignited. When the engine 11 is in a normal operating state such as at full load, the pressure of the exhaust 18 can be relatively high and the amount of the exhaust 18 can be relatively large. Thus, most of the exhaust 18 can be discharged into the water 2 against water pressure through the exhaust passage 48 of the exhaust manifold 47. A small amount of the rest of the exhaust 18 can be discharged to the ambient atmosphere through the idling exhaust passage 57. The rotation (R) of the crankshaft 22 by the operation of the engine drives the propeller 10 via the power transmission apparatus 12 to thereby propel the watercraft 1.

When the engine 11 is idle, the pressure of the exhaust 18 can be relatively low and the amount of the exhaust can be relatively small. Thus, due to water pressure, the exhaust 18 can be prevented from being discharged into the water 2 through the exhaust passage 48 of the exhaust manifold 47, and thus most of the exhaust 18 can be discharged to the ambient atmosphere through the idling exhaust passage 57.

Figure 4:
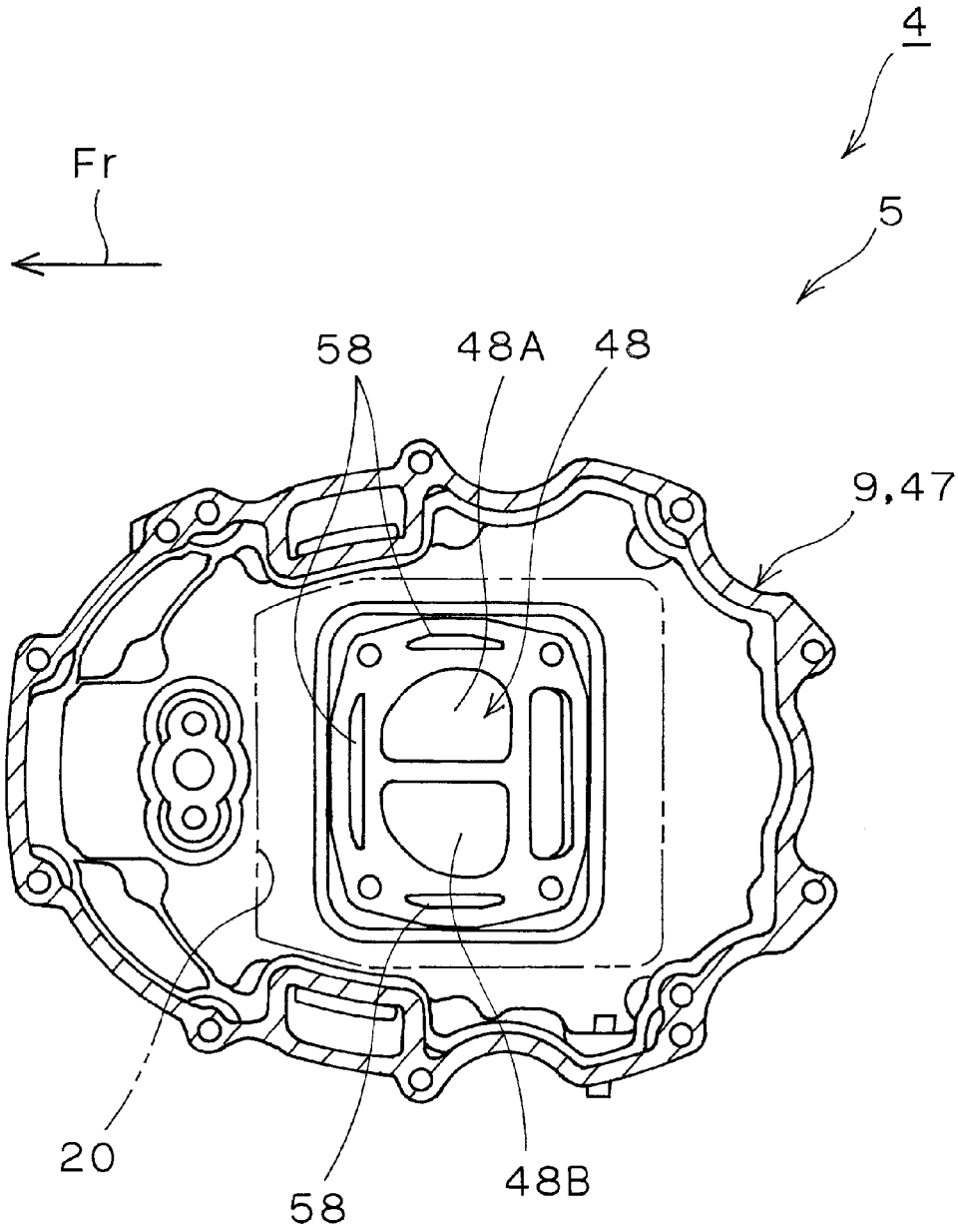
FIG. 4 is a cross-sectional view taken along the line IV-IV in FIG. 3.
Figure 5:
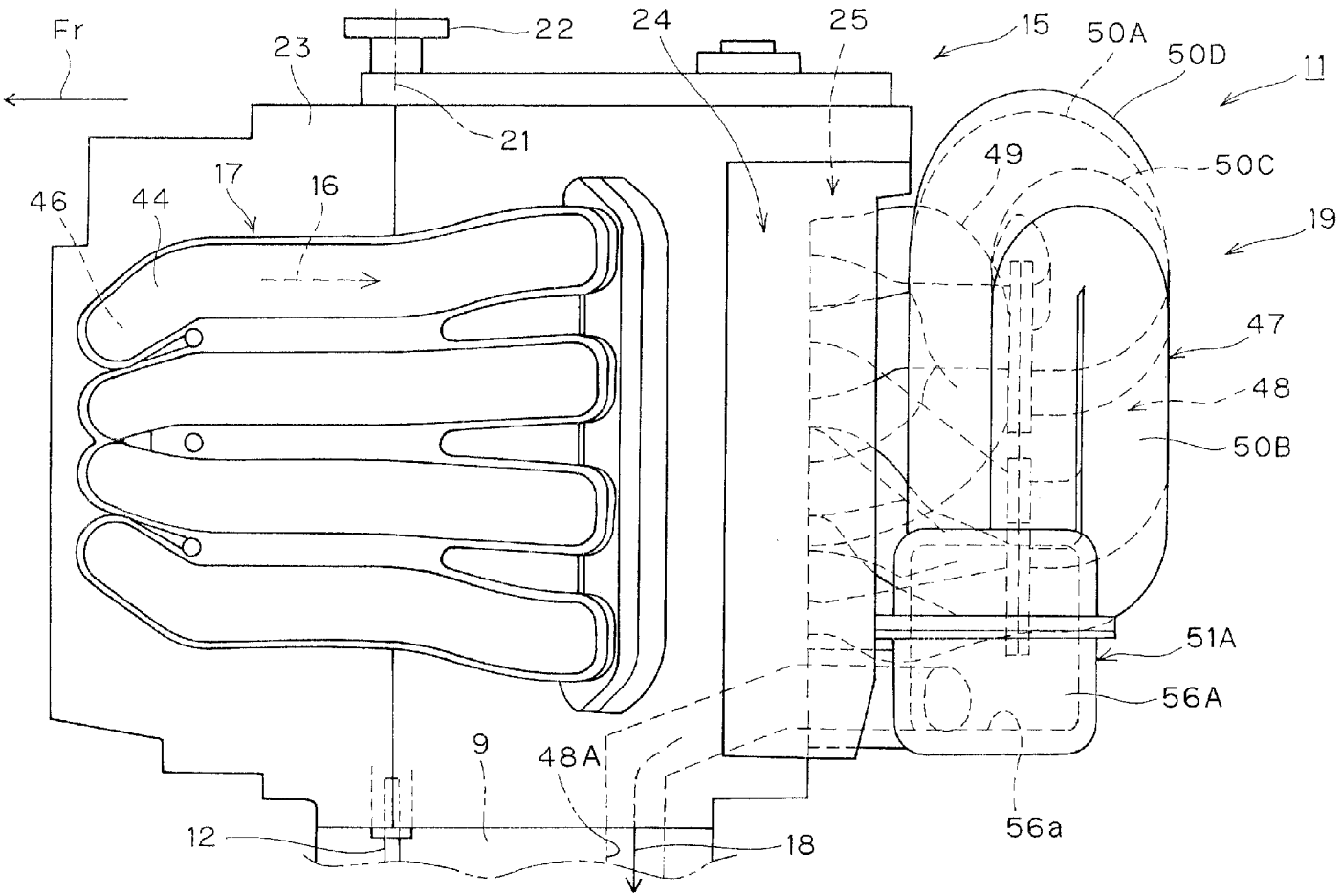
FIG. 5 is a schematic side elevational view of the engine, with certain components of the exhaust system shown in phantom line.

Referring to FIGS. 1, 4 and 8, regulating parts 78 can be formed at the downstream ends of the respective midway exhaust pipes 50, or midway parts of the exhaust passage 48 thereof The opening of the regulating parts 78 can be made variable by a plurality of (four) butterfly regulating valves 79 individually provided at the downstream ends of the midway exhaust pipes 50. The regulating valves 79 can be operatively connected to each other to selectively open and close together. An actuator (not shown) can be provided for moving the regulating valves. It is understood that the regulating valves 79 may be moved individually.

With the above structure, the exhaust manifold 47 includes the first to eighth upstream exhaust pipes 49A to 49H extending respectively from the first to eighth cylinders 27A to 27H. The first to fourth midway exhaust pipes 50A to 50D extend respectively from a joined portion of the extended ends of the first and fifth upstream exhaust pipes 49A and 49E, a joined portion of the extended ends of the second and sixth upstream exhaust pipes 49B and 49F, a joined portion of the extended ends of the third and seventh upstream exhaust pipes 49C and 49G, and a joined portion of the extended ends of the fourth and eighth upstream exhaust pipes 49D and 49H. The first and second downstream exhaust pipes 51A and 51B extend respectively from a joined portion of the extended ends of the first and third midway exhaust pipes 50A and 50C and a joined portion of the extended ends of the second and fourth midway exhaust pipes 50B and 50D for connecting the respective joined portion to the ambient atmosphere.

As a result, an exhaust 18 from the first cylinder 27A, for example, flows sequentially through the first upstream exhaust pipe 49A, the first midway exhaust pipe 50A and the first downstream exhaust pipe 51A to the ambient atmosphere. Next, an exhaust 18 from the second cylinder 27B flows sequentially through the second upstream exhaust pipe 49B, the second midway exhaust pipe 50B and the second downstream exhaust pipe 51B to the ambient atmosphere. Next, an exhaust 18 can be discharged from the third cylinder 27C. This exhaust 18 will be discussed in greater detail below. Next, an exhaust 18 from the fourth cylinder 27D flows sequentially through the fourth upstream exhaust pipe 49D, the fourth midway exhaust pipe 50D and the second downstream exhaust pipe 51B to the ambient atmosphere. Thus, the subsequent pulses of exhaust 18 discharged from the second cylinder 27B and the fourth cylinder 27D can be prevented from interfering with the exhaust 18 from the first cylinder 27A in the upstream exhaust pipes 49, the midway exhaust pipes 50 and the downstream exhaust pipes 51.

The exhaust 18 from the third cylinder 27C described above flows sequentially through the third upstream exhaust pipe 49C, the third midway exhaust pipe 50C and the first downstream exhaust pipe 51A to the ambient atmosphere. Thus, both the exhaust 18 from the first cylinder 27A and the exhaust 18 from the third cylinder 27C flow through the first downstream exhaust pipe 51A. Accordingly, the exhaust 18 from the third cylinder 27C may interfere with the exhaust 18 from the first cylinder 27A in the first downstream exhaust pipe 51A.

Advantageously, the first upstream exhaust pipe 49A and the first midway exhaust pipe 50A, through which the exhaust 18 from the first cylinder 27A flows, and the third upstream exhaust pipe 49C and the third midway exhaust pipe 50C, through which the exhaust 18 from the third cylinder 27C flows, can be separate from each other and have a relatively long length. For this reason, the first and third cylinders 27A and 27C can be far away from each other because of the first exhaust passage 48. Thus, the exhaust 18 from the third cylinder 27C can be prevented from interfering with the exhaust 18 from the first cylinder 27A in the first downstream exhaust pipe 51A.

The first cylinder 27A and the fifth cylinder 27E can be positioned in proximity to each other because the first and fifth upstream exhaust pipes 49A and 49E, extending from the first cylinder 27A and the fifth cylinder 27E, can be joined to each other. However, the ignition interval between the first cylinder 27A and the fifth cylinder 27E can be significantly long due to ignitions of the second to fourth cylinders 27B to 27D occurring therebetween. As a result, overlapping of the exhaust strokes of the first cylinder 27A and the fifth cylinder 27E can be prevented. Thus, the exhaust 18 from the fifth cylinder 27E can be prevented from interfering with the exhaust 18 from the first cylinder 27A in the first and fifth upstream exhaust pipes 49A and 49E.

The interval between ignition of the first cylinder 27A and ignitions of the sixth to eighth cylinders 27F to 27H can be even longer. As a result, the exhausts 18 from the sixth to eighth cylinders 27F to 27H can be prevented from interfering with the exhaust 18 from the first cylinder 27A.

The above description of the exhaust 18 from the first cylinder 27A can apply to the exhaust 18 from the other cylinders 27. As a result, interference of the exhaust pulses in the engine 11 can be prevented, and thus desired exhaust pulses having a sufficiently high negative pressure can be obtained. Therefore, the enhanced performance of the engine 11 can be achieved more reliably.

As described above, each pair of the first and fifth upstream exhaust pipes 49A and 49E, the second and sixth upstream exhaust pipes 49B and 49F, the third and seventh upstream exhaust pipes 49C and 49G, and the fourth and eighth upstream exhaust pipes 49D and 49H have approximately the same equivalent length.

Of the exhausts 18 from the first to eighth cylinders 27A to 27H, the following can be more likely to interfere with each other: the exhausts 18 from the first and fifth cylinders 27A and 27E in the first and fifth upstream exhaust pipes 49A and 49E joined to each other; the exhausts 18 from the second and sixth cylinders 27B and 27F in the second and sixth upstream exhaust pipes 49B and 49F; the exhausts 18 from the third and seventh cylinders 27C and 27G in the third and seventh upstream exhaust pipes 49C and 49G; and the exhausts 18 from the fourth and eighth cylinders 27D and 27H in the fourth and eighth upstream exhaust pipes 49D and 49H.

Therefore, as described above, the first and fifth upstream exhaust pipes 49A and 49E, for example, in which interference of exhaust can be more likely to occur, have approximately the same equivalent length.

As a result, interference of exhaust 18 from the first cylinder 27A with an exhaust 18 from the fifth cylinder 27E ignited fourth after the first cylinder 27A and interference of the exhaust 18 from the fifth cylinder 27E with an exhaust 18 from the first cylinder 27A ignited fourth after the fifth cylinder 27E can be set to about the same level. That is, interference between the exhausts 18 from the first and fifth cylinders 27A and 27E for example can be minimized and more balanced. This ensures the excellent and stable performance of the engine.

As described above, the engine 11 having the plurality of cylinders 27, the first expansion chamber case 56A for collecting therein exhausts 18 from the first part of the cylinders 27, and the second expansion chamber case 56B for collecting therein exhausts 18 from the second part of the cylinders 27 can be provided. The first and second exhaust passages 48A and 48B can be formed extending individually from the first and second expansion chamber cases 56A and 56B, respectively, and communicating with the water 2 at the downstream end openings 48*a* to 48*d*.

As a result, when the exhaust 18 from some cylinders 27A, 27C, 27E, 27G of the plurality of cylinders 27 and the exhaust 18 from the other cylinders 27B, 27D, 27F, 27H flow respectively into the first and second expansion chamber cases 56A and 56B, vibration caused by the pressure of those exhausts can be dampened. Thereafter, the respective exhaust flows can be discharged individually into the water 2 through the first and second exhaust passages 48A and 48B. Thus, mutual interference of the respective exhausts 18 can be prevented more reliably. As a result, interference of the exhausts in the engine 11 can be prevented effectively, and thus desired exhaust pulses having a sufficiently high negative pressure can be obtained. The enhanced performance of the engine 11 can be thereby achieved more reliably.

As described above, of the cylinders 27, the cylinders 27A, 27C, 27E, 27G ignited in odd-numbered order can be referred to as the first part of the cylinders 27, and the cylinders 27B, 27D, 27F, 27H ignited in even-numbered order can be referred to as the second part of the cylinders 27.

Incidentally, the exhaust 18 from the cylinders ignited in odd-numbered (or even-numbered) order can be most significantly interfered with the subsequent exhausts 18 from the cylinders ignited in even-numbered (or odd-numbered) order.

Thus, in some embodiments, the pulses of exhaust 18 from the cylinders 27 ignited in odd-numbered order and the pulses of exhaust 18 from the cylinders 27 ignited in even-numbered order can be discharged individually into the water 2. As such, of interferences of the pulses of exhaust 18, maximum possible interference can be prevented, and the enhanced performance of the engine can be achieved effectively.

As described above, the downstream end openings 48*c*, 48*d* of the first and second exhaust passages 48A and 48B can be formed in the longitudinal midway part of the case 9 below the surface 2*a* of the water 2. The partition 52 can be provided extending in the longitudinal direction of the hull 3 to separate the propeller 10 and the downstream end openings 48*c*, 48*d* and being supported by the case 9.

As a result, when the exhaust 18 from the cylinders 27 is discharged into the water 2 through the downstream end openings 48*c*, 48*d*, the exhaust 18 can be prevented from flowing toward the propeller 10. Thus, cavitation that might occur around the propeller 10 due to the exhaust 18 can be prevented.

As described above, the water guide 53 can be positioned above the downstream end openings 48*c*, 48*d* of the first and second exhaust passages 48A and 48B, facing the partition 52 in a vertical direction, extending generally parallel to the partition 52 and can be supported by the case 9.

As a result, when the watercraft 1 is driven forward by the outboard motor 4, the exhausts 18 from the cylinders 27 are discharged into the water 2 through the downstream end openings 48*c*, 48*d*. As such, the exhaust 18 can be carried farther away from the watercraft 1 in the rearward direction by the water flowing rearwardly along the water passages 54 between the partition 52 and the water guide 53. Then, the exhausts 18 come up from the water 2 to be released into the ambient atmosphere.

Accordingly, the downstream end openings 48*c*, 48*d* described above can be positioned nearer to the surface 2*a* of the water 2 as compared to the case where the downstream end openings 48*c*, 48*d* are formed at the lower end of the case 9. In this case, however, the exhausts 18 discharged into the water 2 through the downstream end openings 48*c*, 48*d* can be prevented from being released immediately into the ambient atmosphere. Therefore, the influence of the exhaust noise on the passengers on the watercraft 1 can be reduced advantageously.

It is understood that the above description is based on the illustrated example; however, the engine 11 may be a four-cylinder or six-cylinder engine. It is also understood that the banks 24, 25 can be arranged in a laterally inverse form. It is also understood that the lower and upper downstream end openings 48*a* to 48*d* in the case 9 can be only the lower or upper downstream end openings.

FIGS. 11 to 21 illustrate modifications of the exhaust systems and engines described above with reference to FIGS. 1-10. The modifications described below can have many parts, components, and methods of use in common with the exhaust systems and engines of FIGS. 1-10. Therefore, those parts and components are identified with the same reference numerals in the drawings and their description, as well as a description of a method if use, is not repeated. Their optional differences, however, are described below. The configurations of the parts and components described above can be combined with the modifications described below in various ways.

Referring to FIGS. 11 to 14, one (left) bank 24 of the banks 24, 25 can be formed by the first, third, seventh and fifth cylinders 27A, 27C, 27G and 27E. The other (right) bank 25 can be formed by the second, fourth, eighth and sixth cylinders 27B, 27D, 27H and 27F.

The first, third, seventh and fifth upstream exhaust pipes 49A, 49C, 49G and 49E, the first and third midway exhaust pipes 50A and 50C, and the first downstream exhaust pipe 51A, which can be associated with the first, third, seventh and fifth cylinders 27A, 27C, 27G and 27E, can be arranged to the left of the crankshaft 22. The other exhaust pipes associated with the second, fourth, eighth and sixth cylinders 27B, 27D, 27H and 27F can be arranged to the right of the crankshaft 22.

The exhaust passage 48 of each midway exhaust pipe 50 can have a plurality of (two) catalysts 60, 61 disposed therein longitudinally. The catalysts 60, 61 can be three-way catalysts for purifying exhaust 18. The catalysts 60, 61 can also have a longitudinal length longer than a radial length in the exhaust passage 48.

Of the first and second secondary airs 63, 64, the second secondary air 64 supplied to the downstream side of the first exhaust passage 48 can be supplied to a part of the first exhaust passage 48 between the catalysts 60, 61 via the second air passage 67 and the reed valve 68. Both the $O_2$ sensors 72, 73 can be disposed downstream of the catalysts 60, 61.

With the above structure, the catalysts 60, 61 for purifying exhaust can be disposed in the exhaust passage 48 in the exhaust manifold 47. The first air passage 65 can be formed for supplying first secondary air 63 to the upstream side of the catalysts 60, 61 in the exhaust passage 48.

As described above, since exhaust pulses having a sufficiently high negative pressure can be obtained, first and second secondary airs 63 and 64 can be sucked more smoothly into the exhaust passage 48 due to the negative pressure. That is, a larger amount of first and second secondary airs 63, 64 can be supplied into the exhaust passage 48. Thus, even when the air-fuel ratio (A/F) of the mixture to be supplied to the engine body 15 of the engine 11 by the intake device 17 is small (rich), the exhaust air-fuel ratio on the upstream side of the catalysts 60, 61 can be set to a desired value such as a theoretical air-fuel ratio. More reliable purification of exhaust 18 can be thereby achieved. That is, as a result of such purification of exhaust 18, the enhanced performance of the engine 11 can be achieved more reliably.

As described above, the catalysts 60, 61 have a longitudinal length longer than a radial length in the exhaust passage 48.

In some embodiments, the above engine 11 can be incorporated in the outboard motor 4. Compared to the case where the engine 11 is incorporated in a commercially available automobile, the engine 11 incorporated into an outboard motor will often be operated at a maximum output point under full load. As a result, the flow speed of exhaust 18 in the exhaust passage 48 becomes relatively high. Thus, in such embodiments, the catalysts 60, 61 can have a longer length as described above. This ensures that the exhaust 18 is exposed to the catalysts 60, 61 for a longer amount of time. As a result, more reliable purification of the exhaust 18 can be achieved. That is, the enhanced performance of the engine 11 can be achieved more reliably.

Figure 11:
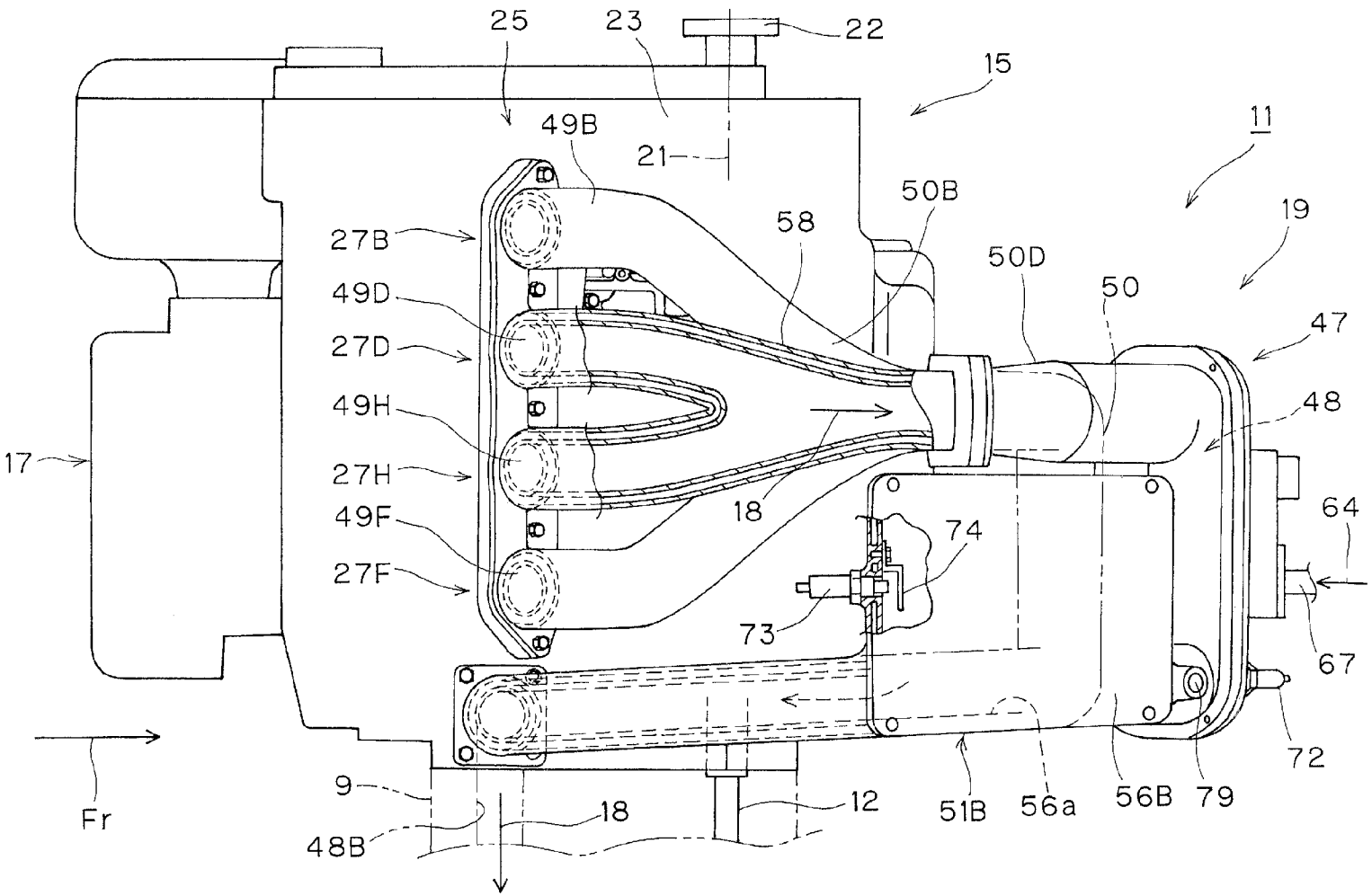
FIG. 11 is a schematic side elevational view of a modification of the engine of FIGS. 1-10, with certain components of the exhaust system shown in phantom line.
Figure 12:
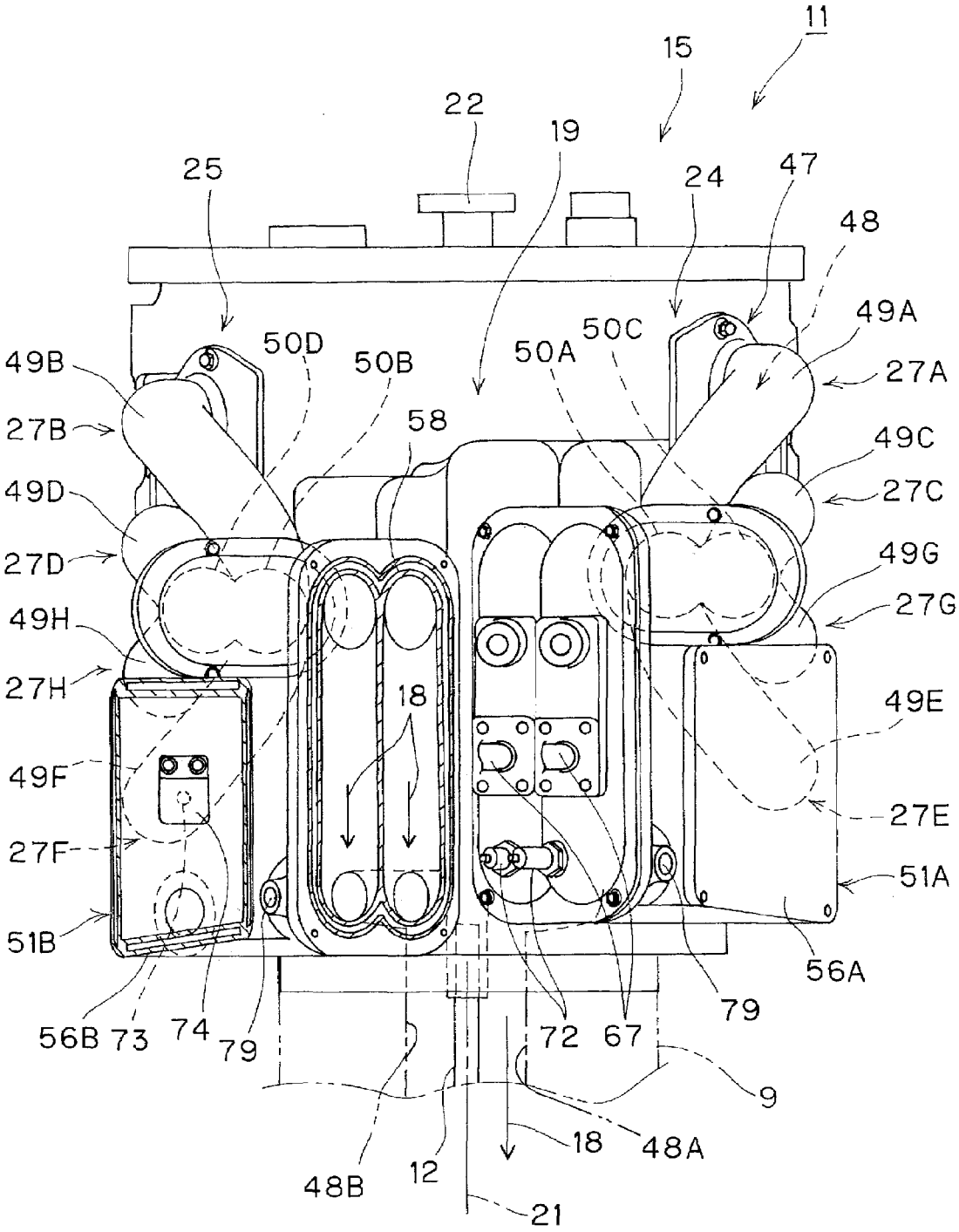
FIG. 12 is a front view of the engine of FIG. 11, with certain covers removed and certain components shown in phantom line.
Figure 13:
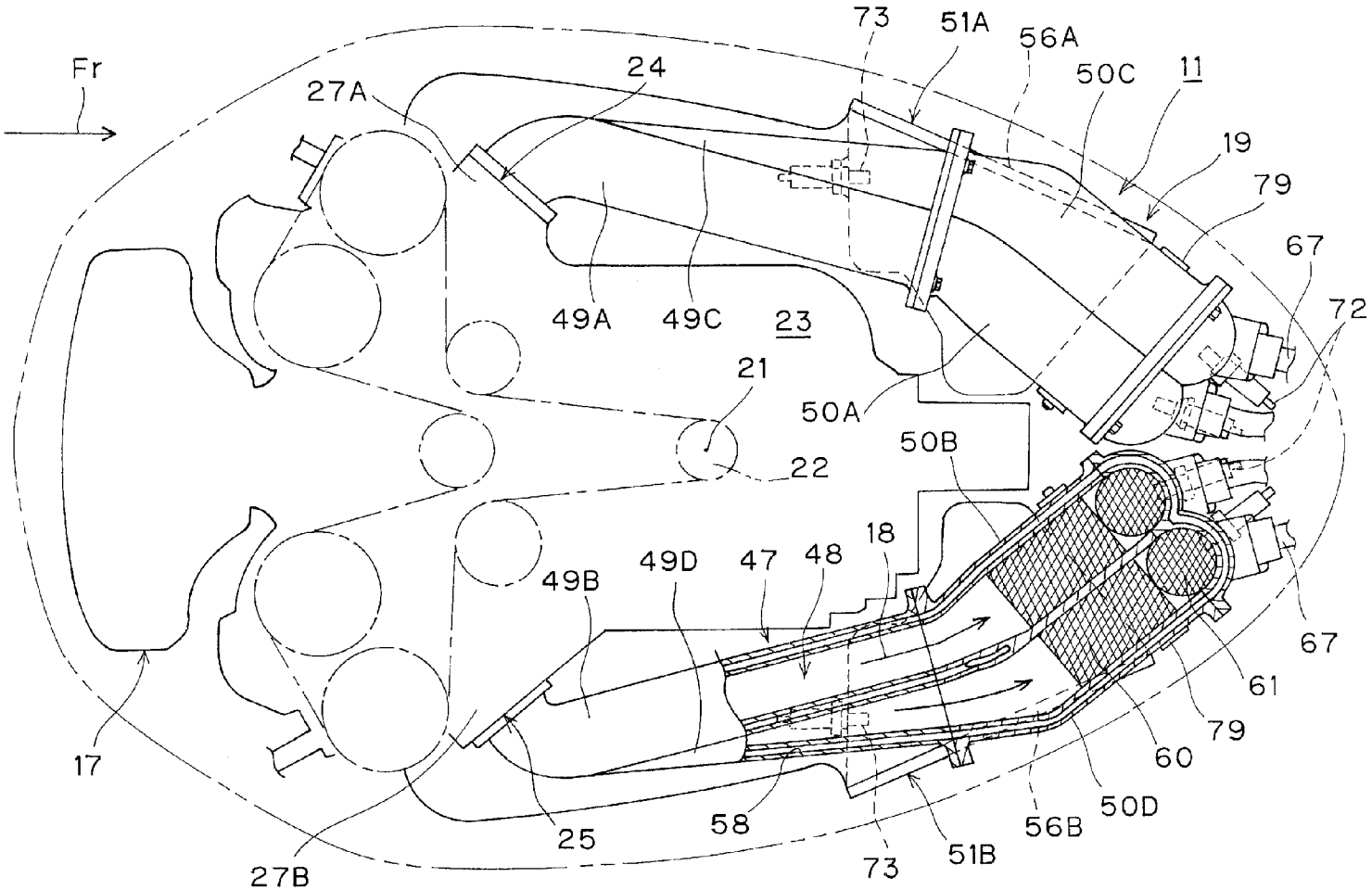
FIG. 13 is a top plan and partial cross-sectional view of the engine of FIG. 11.
Figure 14:
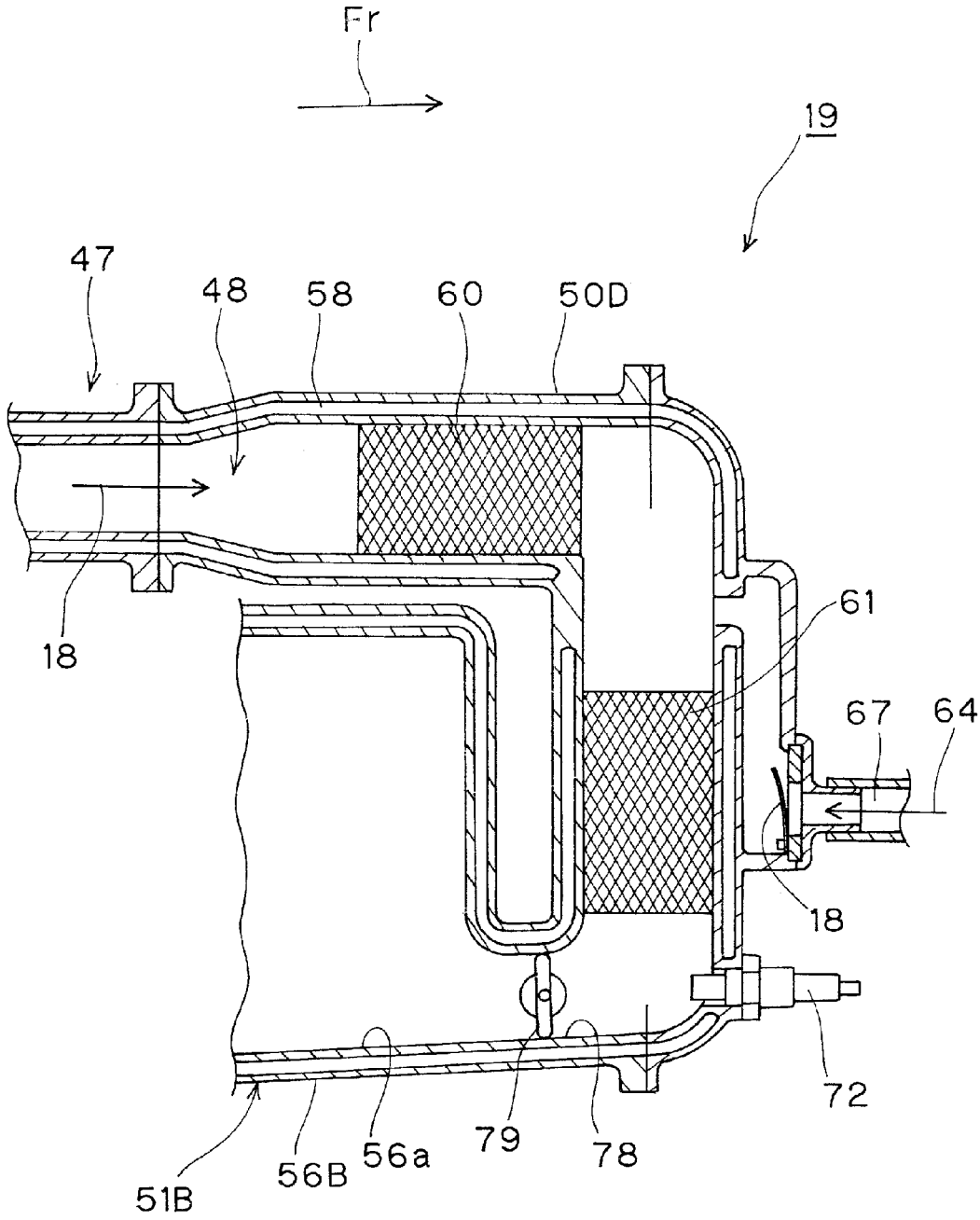
FIG. 14 is an enlarged cross-sectional view of a portion of FIG. 11.
Figure 15:
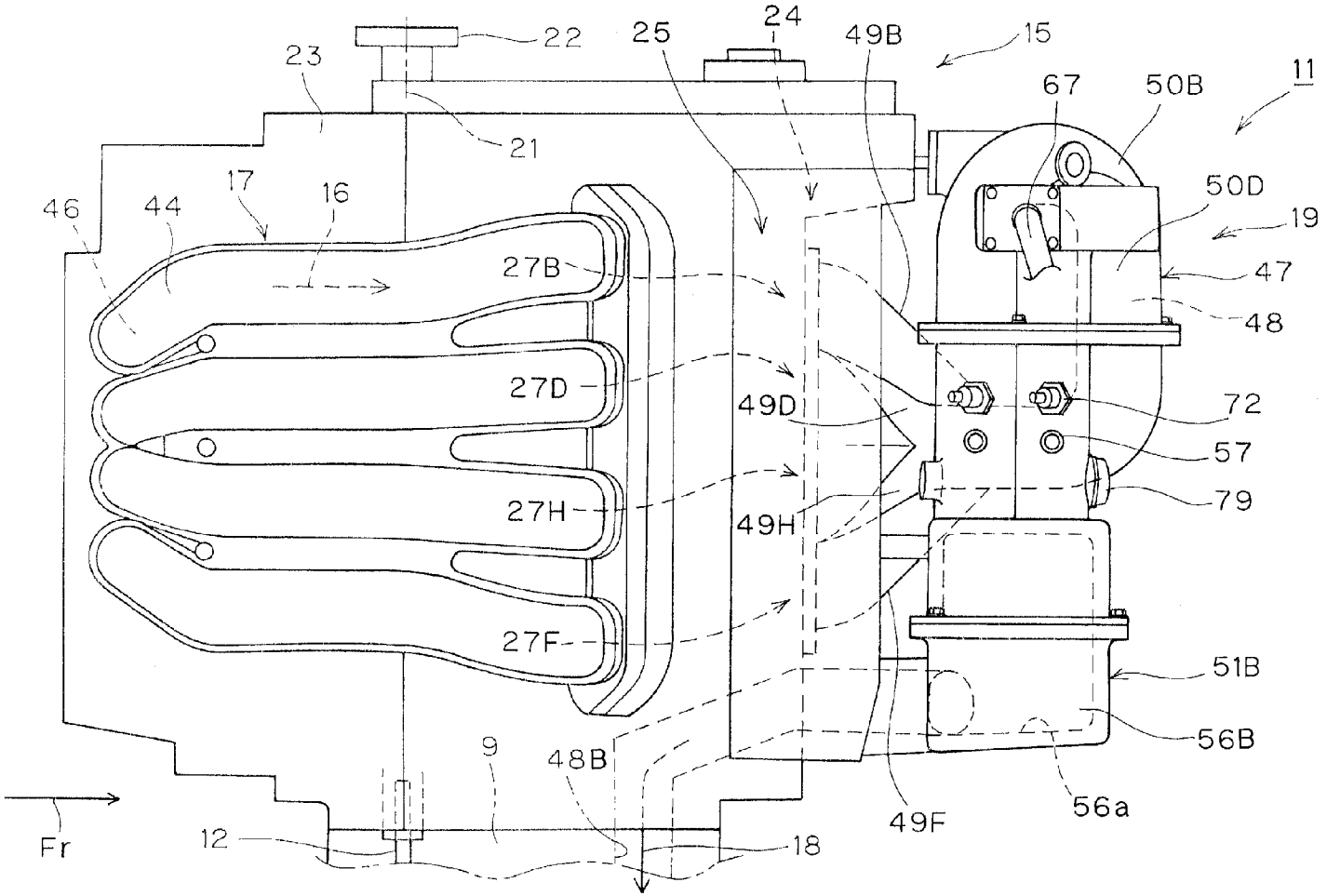
FIG. 15 is a schematic side elevational view of another modification of the engine of FIGS. 1-10, with certain components of the exhaust system shown in phantom line.
Figure 16:
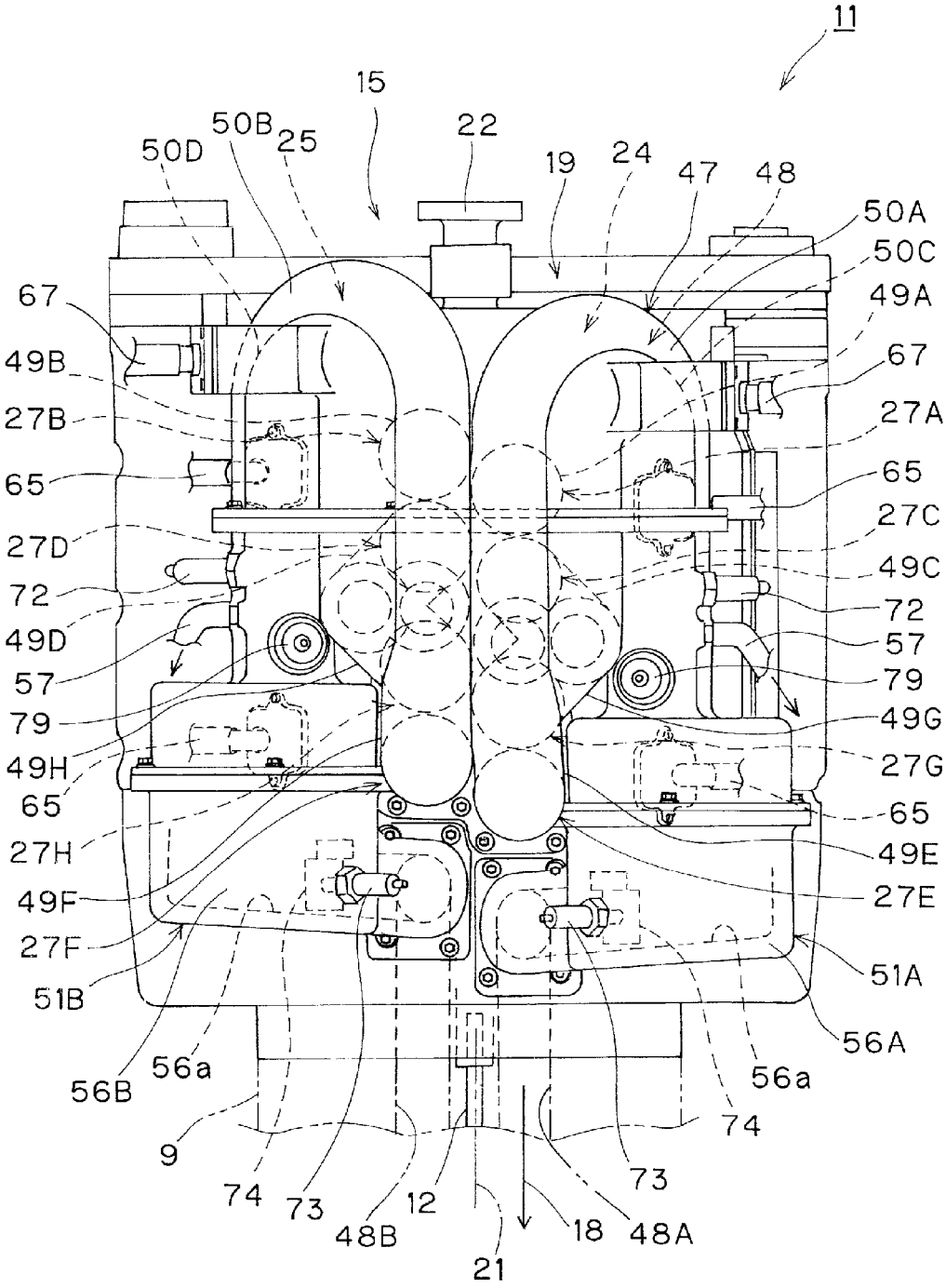
FIG. 16 is a front view of the engine of FIG. 15.
Figure 17:
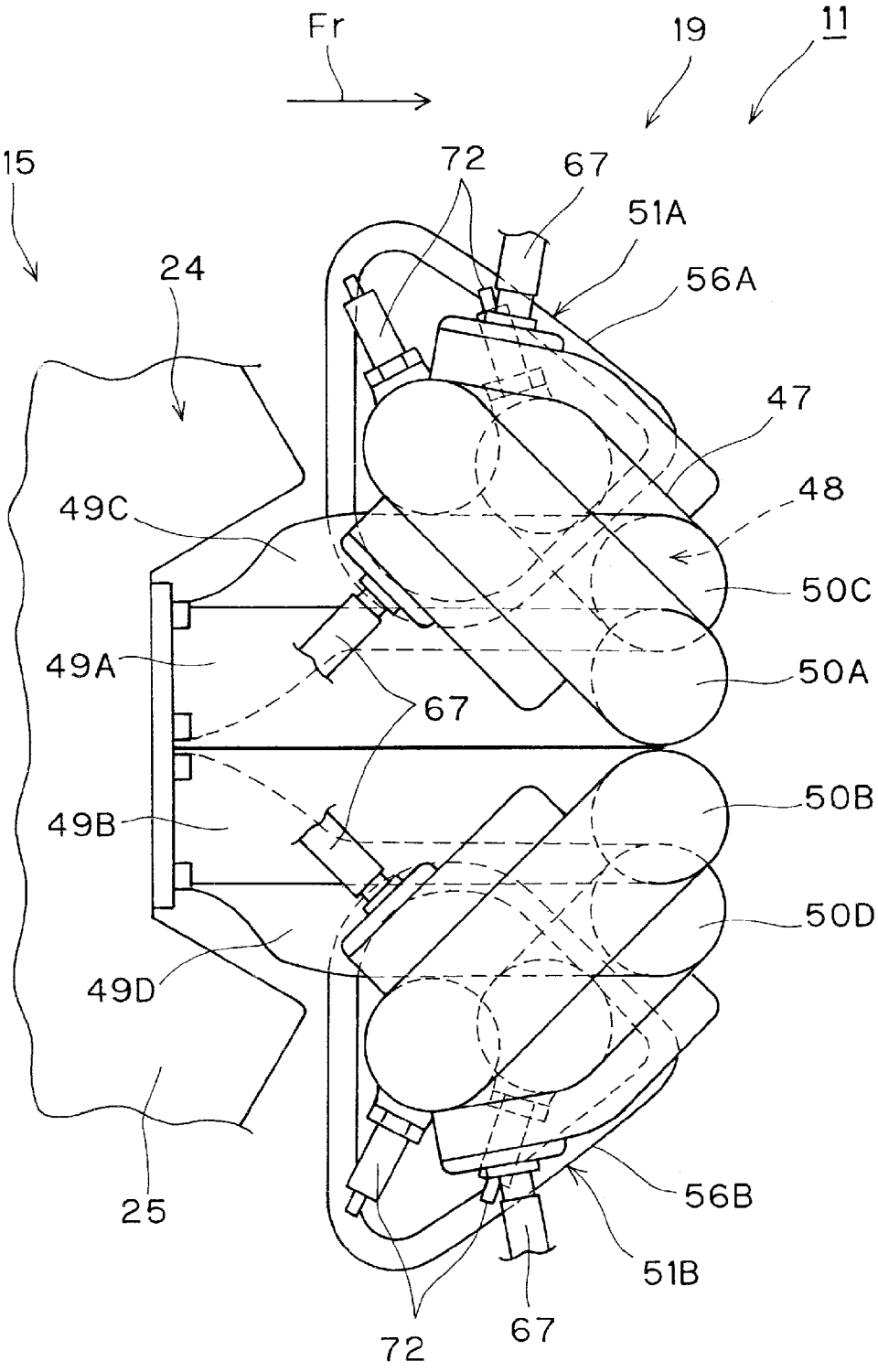
FIG. 17 is a plan view of a portion of the engine of FIG. 15.
Figure 18:
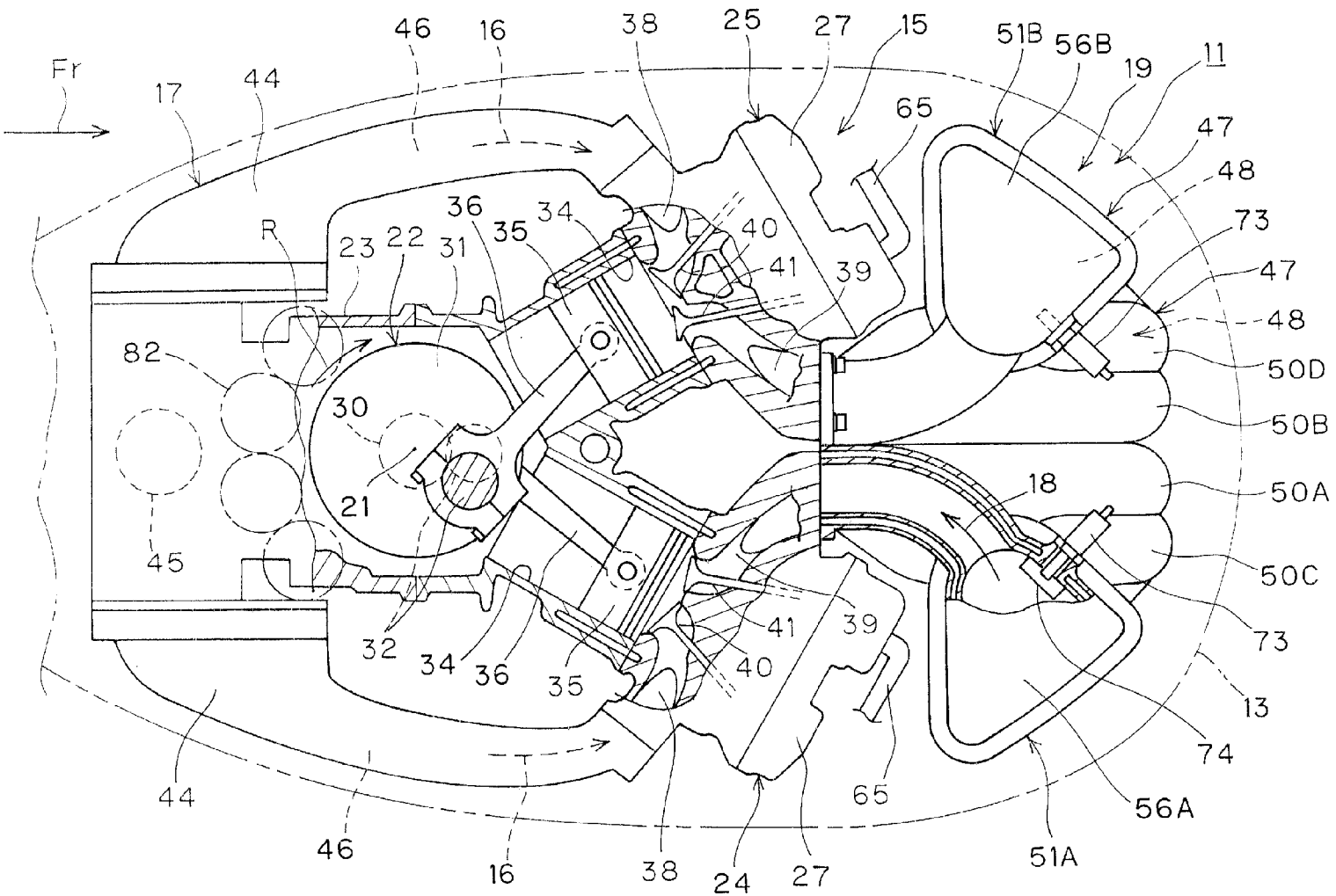
FIG. 18 is a partial bottom plan and schematic cross-sectional view of the engine of FIG. 15.
Figure 19:
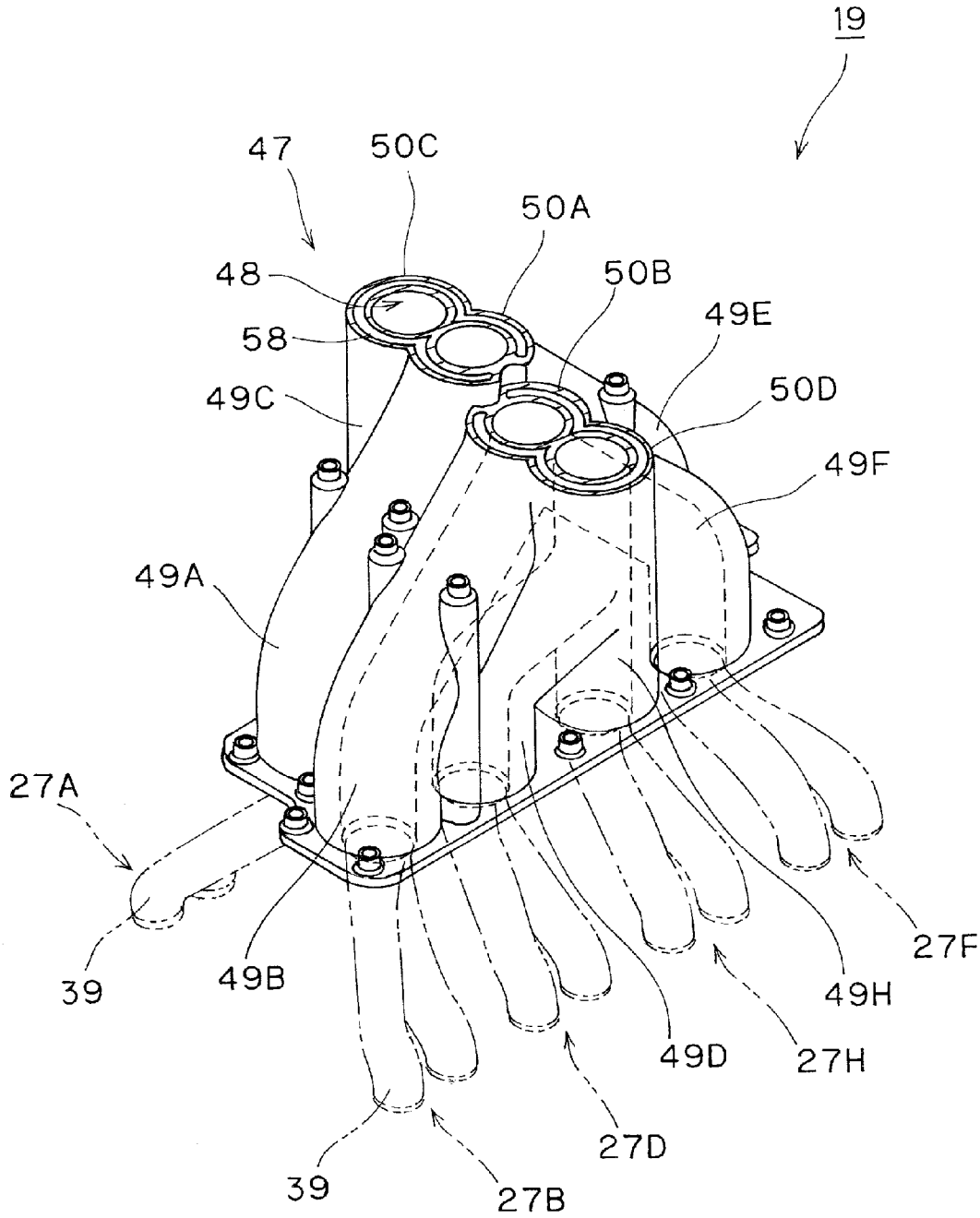
FIG. 19 is a perspective view of a portion of the exhaust device that can be used with the exhaust system of the engine of FIG. 15.
Figure 20:
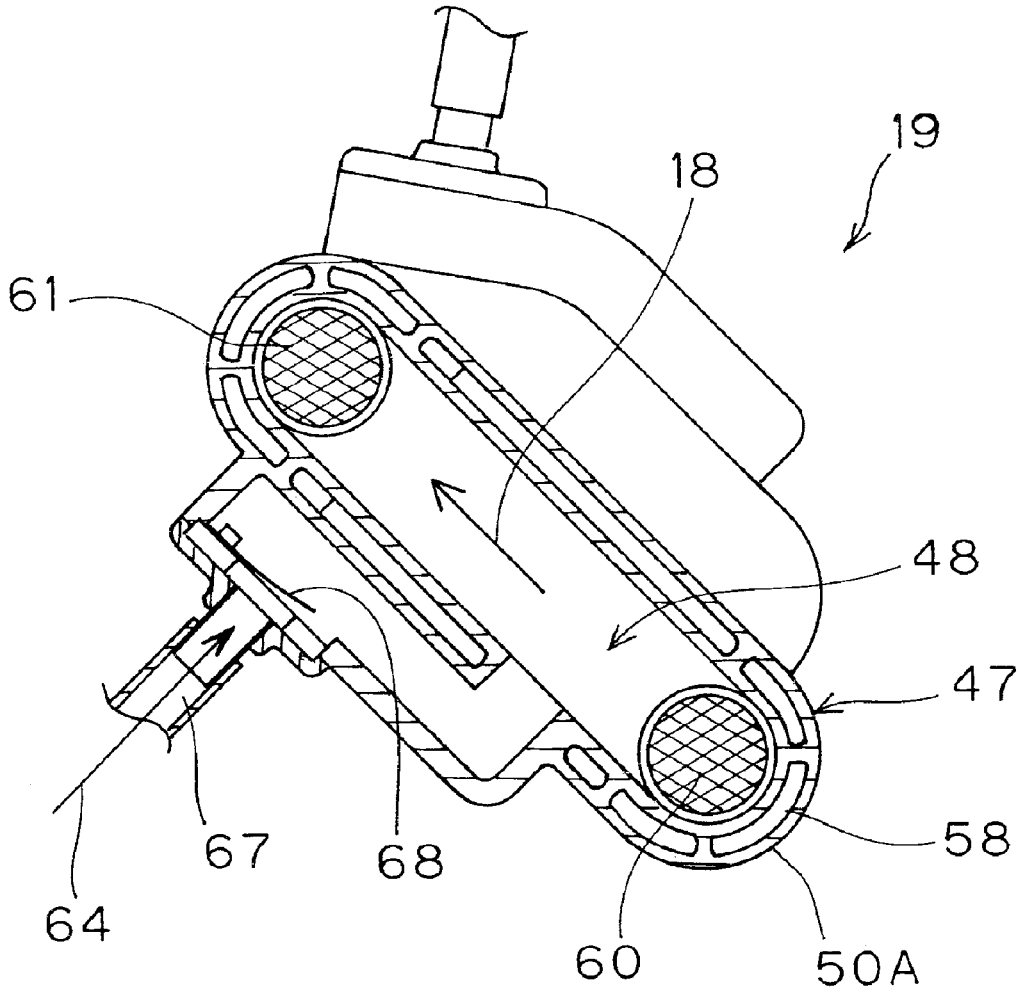
FIG. 20 is an enlarged cross-sectional view of a portion of FIG. 17.
Figure 21:
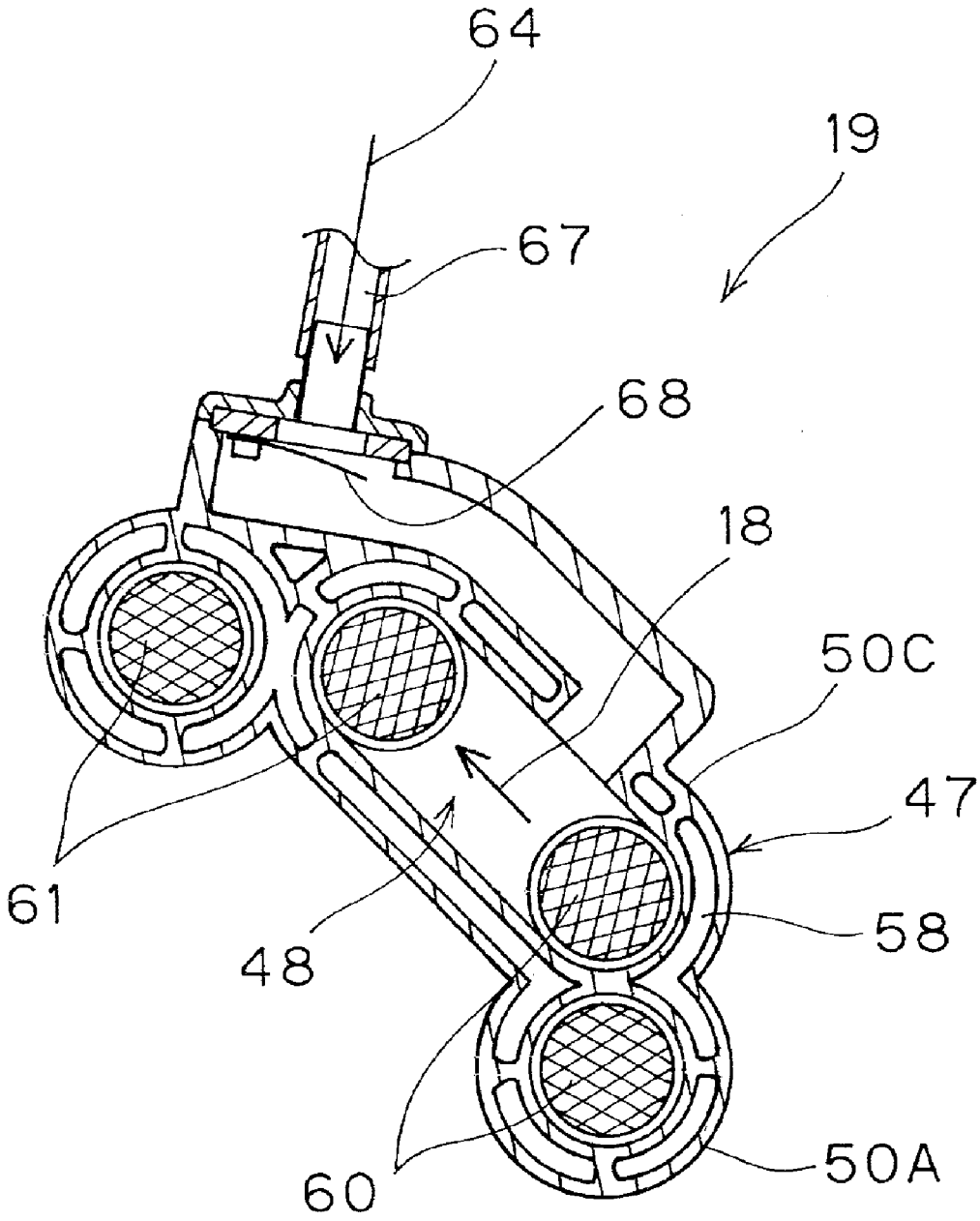
FIG. 21 is an enlarged cross-sectional view of another portion of FIG. 17.

It is understood that the midway exhaust passages 50 may be shorter in length as indicated by chain double-dashed lines in FIG. 11.

With regard to the modifications illustrated in FIGS. 15 to 21, the engine and exhaust systems therein can be essentially the same as that of FIGS. 11-14 except that generally the entire exhaust device 19 is arranged in front of the engine body 15. Additionally, balancers 82 can be operatively connected to the crankshaft 22.

The idling exhaust passage 57 can be formed for communicating longitudinal "midway parts" of the exhaust passage 48 in the midway exhaust pipes 50 to the ambient atmosphere above the surface of the water 2. The regulating part 78 having the regulating valve 79 to vary its opening can be provided on the downstream side of and in proximity to the "midway part" of the exhaust passage 48.

With the above structure, firstly, proper adjustment of the opening of the regulating part 78 according to the operating state of the engine 11 allows the pressure of the exhaust 18 flowing through the midway exhaust pipe 50 to be reversed by the regulating part 78, so that exhaust pulses having a desired negative pressure can be obtained at desired timing. Thus, the more enhanced performance of the engine 11 can be provided.

Secondly, the following operation and effect can be obtained. When the hull 3 is driven rearward in response to the operation of the switching device 14 of the power transmission apparatus 12 in the outboard motor 4, the water 2 may flow back through the exhaust passage 48 of the downstream exhaust pipe 51 and enter the idling exhaust passage 57, due to the dynamic pressure of the water 2. In this case, since both the exhaust passages 48, 57 are obstructed, the engine 11 may lose speed or stop.

Thus, in response to the operation of the switching device 14 to drive the hull 3 rearward, if automatic control, manual operation or the like is performed to close the regulating valve 79 to decrease the opening of the regulating part 78, the entry of the water 2 into the idling exhaust passage 57 can be prevented by the regulating part 78. Thus, the flow of exhaust 18 at least through the idling exhaust passage 57 can be ensured. As a result, the engine 11 can be prevented from losing speed or stopping due to backflow of the water 2 through the exhaust passage 48. Advantageously, the stable operation of the engine 11 can be continuously effected.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An exhaust device for an outboard motor, comprising:

an engine having a plurality of cylinders;

a first expansion chamber case configured to collect therein exhaust from a first part of the plurality of cylinders;

a second expansion chamber case configured to collect therein exhaust from a second part of the plurality of cylinders; and first and second exhaust passages extending individually from the first and second expansion chamber cases, respectively, each of the first and second exhaust passages having a downstream end opening communicating with water, wherein the outboard motor includes a case extending generally vertically and supported on a hull such that a lower part of the case is submerged in water, and a propeller supported at a lower end of the case, the downstream end openings of the first and second exhaust passages being formed in a longitudinal midway part of the case below a surface of the water, the exhaust device further comprising a partition extending in a longitudinal direction of the hull and separating the propeller and the downstream end openings, the partition being supported by the case.

2. An exhaust device for an outboard motor, comprising:

an engine having a plurality of cylinders;

a first expansion chamber case configured to collect therein exhaust from a first part of the plurality of cylinders;

a second expansion chamber case configured to collect therein exhaust from a second part of the plurality of cylinders; and first and second exhaust passages extending individually from the first and second expansion chamber cases, respectively, each of the first and second exhaust passages having a downstream end opening communicating with water, wherein the first part of the plurality of cylinders comprises cylinders ignited in odd-numbered order, and the second part of the plurality of cylinders comprises cylinders ignited in even-numbered order, wherein the outboard motor includes a case extending generally vertically and supported on a hull such that a lower part of the case is submerged in water, and a propeller supported at a lower end of the case, the downstream end openings of the first and second exhaust passages being formed in a longitudinal midway part of the case below a surface of the water, the exhaust device further comprising a partition extending in a longitudinal direction of the hull and separating the propeller and the downstream end openings, the partition being supported by the case.

3. The exhaust device for an outboard motor according to claim 1 further comprising a water guide above the downstream end openings of the first and second exhaust passages, the water guide facing the partition in a vertical direction, extending generally parallel to the partition and being supported by the case.

4. The exhaust device for an outboard motor according to claim 2 further comprising a water guide above the downstream end openings of the first and second exhaust passages, the water guide facing the partition in a vertical direction, extending generally parallel to the partition and being supported by the case.

5. An outboard motor comprising:

an engine having a plurality of cylinders;

a case including a lower portion configured to be submerged in water during operation of the outboard motor;

a first expansion chamber case configured to collect therein exhaust from a first group of the plurality of cylinders;

a second expansion chamber case configured to collect therein exhaust from a second group of the plurality of cylinders;

first and second exhaust passages extending individually from the first and second expansion chamber cases, respectively, each of the first and second exhaust passages having separate downstream end openings disposed on the lower portion; and a propeller supported at a lower end of the case and a partition extending in a longitudinal direction of the case and separating the propeller and the downstream end openings.

6. An outboard motor comprising:

an engine having a plurality of cylinders;

a case including a lower portion configured to be submerged in water during operation of the outboard motor;

a first expansion chamber case configured to collect therein exhaust from a first group of the plurality of cylinders;

a second expansion chamber case configured to collect therein exhaust from a second group of the plurality of cylinders;

first and second exhaust passages extending individually from the first and second expansion chamber cases, respectively, each of the first and second exhaust passages having separate downstream end openings disposed on the lower portion; and a propeller supported at a lower end of the case and a partition extending in a longitudinal direction of the case and separating the propeller and the downstream end openings;

wherein the first group of cylinders comprises cylinders ignited in odd-numbered order, and the second group of cylinders comprises cylinders ignited in even-numbered order.

7. The outboard motor according to claim 5 further comprising a water guide above the downstream end openings of the first and second exhaust passages, the water guide facing the partition in a vertical direction, extending generally parallel to the partition and being supported by the case.

8. The outboard motor according to claim 6 further comprising a water guide above the downstream end openings of the first and second exhaust passages, the water guide facing the partition in a vertical direction, extending generally parallel to the partition and being supported by the case.

* * * * *